US009168936B2

(12) United States Patent
Grimm et al.

(10) Patent No.: US 9,168,936 B2
(45) Date of Patent: Oct. 27, 2015

(54) SYSTEM AND METHOD OF TRANSFORMING MOVEMENT AUTHORITY LIMITS

(71) Applicant: Wabtec Holding Corp., Wilmerding, PA (US)

(72) Inventors: Ann K. Grimm, Cedar Rapids, IA (US); Phillip A. Burgart, Cedar Rapids, IA (US); James H. Moore, Cedar Rapids, IA (US); Rebecca W. Dreasher, Longmont, CO (US)

(73) Assignee: Wabtec Holding Corp., Wilmerding, PA (US)

( * ) Notice: Subject to any disclaimer, the term of this patent is extended or adjusted under 35 U.S.C. 154(b) by 33 days.

(21) Appl. No.: 13/675,336

(22) Filed: Nov. 13, 2012

(65) Prior Publication Data

US 2014/0131524 A1 May 15, 2014

(51) Int. Cl.

| | |
|---|---|
| ***B61L 27/00*** | (2006.01) |
| ***B61L 15/00*** | (2006.01) |
| *B61L 3/00* | (2006.01) |

(52) U.S. Cl.

CPC ..... *B61L 27/00* (2013.01); *B61L 15/0072* (2013.01); *B61L 27/0027* (2013.01); *B61L 27/0038* (2013.01); *B61L 3/008* (2013.01)

(58) Field of Classification Search

CPC ..... B61L 27/04; B61L 2027/005; B61L 27/0027; B61L 3/008; B61L 15/0072; B61L 27/00; B61L 27/0038

USPC ..... 701/19; 246/3, 7, 167 R

See application file for complete search history.

(56) References Cited

U.S. PATENT DOCUMENTS

| | | | |
|---|---|---|---|
| 5,437,422 | A | 8/1995 | Newman |
| 5,947,423 | A | 9/1999 | Clifton et al. |
| 5,950,966 | A | 9/1999 | Hungate et al. |
| 6,865,454 | B2 | 3/2005 | Kane et al. |
| 7,343,314 | B2 | 3/2008 | Matheson et al. |
| 7,512,481 | B2 | 3/2009 | Julich et al. |
| 7,715,977 | B2 | 5/2010 | Julich et al. |
| 7,908,047 | B2 | 3/2011 | Smith et al. |
| 2002/0045975 | A1 | 4/2002 | Carr et al. |
| 2007/0014532 | A1 | 1/2007 | Parisi et al. |
| 2009/0184210 | A1 | 7/2009 | Groves, Jr. et al. |

(Continued)

OTHER PUBLICATIONS

Hartong, M.; Goel, Rajni; Wijesekera, D., "Key management requirements for PTC operations," Vehicular Technology Magazine, IEEE , vol. 2, No. 2, pp. 4,11, Jun. 2007.*

(Continued)

*Primary Examiner* — Helal A Algahaim
*Assistant Examiner* — Donald J Wallace
(74) *Attorney, Agent, or Firm* — The Webb Law Firm

(57) ABSTRACT

A computer-implemented method of transforming movement authority limits for a train traveling in a track network, which includes determining authority of tracks associated with a switch, based at least partially on authority data and/or train authority data for the train, and providing authority on a switch leg of the switch based at least partially on the authority of the associated tracks. The computer-implemented method also includes determining authority of tracks associated with switches on at least two tracks, based at least partially on authority data and/or train authority data for the train, and providing authority on a crossover track between the at least two tracks based at least partially on the authority of the associated tracks.

26 Claims, 14 Drawing Sheets

(56) References Cited

U.S. PATENT DOCUMENTS

| | | | | |
|---|---|---|---|---|
| 2009/0184212 | A1 | 7/2009 | Allshouse et al. | |
| 2009/0198391 | A1 | 8/2009 | Kumar et al. | |
| 2010/0163687 | A1 | 7/2010 | Brand et al. | |
| 2010/0258682 | A1 | 10/2010 | Fries et al. | |
| 2010/0299007 | A1 | 11/2010 | Ghaly | |
| 2011/0035083 | A1 * | 2/2011 | Groves et al. | 701/19 |
| 2011/0172856 | A1 | 7/2011 | Kull | |

OTHER PUBLICATIONS

Reibeling, C., "Positive train control for Australia," Vehicular Technology Magazine, IEEE , vol. 4, No. 4, pp. 35,44, Dec. 2009.*

Alaska Railroad Corporation, "Positive Train Control", Jan. 4, 2012, 2 pages.

BNSF Railway Company, Engineering Services, "Design Guidelines for Industrial Track Projects", May 2011, Revised Dec. 2011, 67 pages.

Calvert, "Centralized Traffic Control", http://mysite.du.edu/~jcalvert/railway/ctc.htm, May 29, 1999, 4 pages.

Federal Railroad Administration, Report to Congress, "Positive Train Control Implementation Status, Issues, and Impacts", Aug. 2012, 53 pages.

Federal Railroad Administration, "User's Manual for the Federal Railroad Administration's Highway-Rail Crossing Data Maintenance System GX 32, Version 2.0", May 29, 2002, 62 pages.

Joint Council on Transit Wireless Communications, "Positive Train Control", Transit Technology Series, May 2012, 25 pages.

"Signals for turnouts" http://xover.mud.at/~invisible/mirror/sig/asr/ensigaws.html, Sep. 3, 2003, 5 pages.

Weart, "Suppliers of dispatching technology and services factor PTC, next-level efficiencies into the planning mix," Progressive Railroading, http://www.progressiverailroading.com/c_s/article/Suppliers-of-dispatching-technology-and-services-factor-PTC-nextlevel-efficiencies-into-the-planning-mix—29104, Dec. 2011, 6 pages.

* cited by examiner

SYSTEM AND METHOD OF TRANSFORMING MOVEMENT AUTHORITY LIMITS

BACKGROUND OF THE INVENTION

1. Field of the Invention

The invention relates generally to vehicle management and control systems, such as, for example, train management and control systems in the railroad industry, and in particular to a movement authority transformation system and method for use in transforming movement authorities, enforcing movement authorities, and/or validating transformations of movement authorities associated with a track network and/or a vehicle, such as, for example, a train, operating within that network.

2. Description of the Related Art

At any given time within a complex track network, multiple trains may operate and traverse the tracks. These trains (and/or the crew) are normally in communication with a dispatch office, which issues movement authorities such as, for example, track warrants and other control authorities, to ensure the safe operation of trains operating in the track network. Each individual train may also include an on-board communication device and a management system that facilitates the safe operation of the train within its local territory in the network. Additionally, to ensure safety and reliability of movement authorities and other control authorities issued to the multiple trains, back office servers may also be used to monitor location reports received from multiple trains and transmit movement authorities and other control authorities to the multiple trains issued by the dispatch office.

In order to facilitate the safe operation of multiple trains traveling in the same or opposite directions on one or more tracks, authorities provided by the dispatch office may be divided into blocks by the back office servers and/or the on-board systems of one or more trains. During such divisions, it is imperative that the authority limits for tracks surrounding the switches or turnouts are correctly transformed into blocks. This is especially true for Positive Train Control (PTC) systems because the movement authorities issued or provided by the dispatch office may be the only means of preventing collisions between trains in dark territories. Consequently, the transformation of movement authorities must not introduce any conflicts of authority when no conflict exists and must not mask or hide any existing conflicts of authority when a conflict does exist. Accordingly, an improved system and method of transforming moment authority limits is provided herein.

SUMMARY OF THE INVENTION

Generally, provided is a system and method of transforming movement authority limits that addresses or overcomes some or all of the various deficiencies and drawbacks associated with vehicle management and control utilizing movement authorities and movement authority transformations.

Accordingly, and in one preferred and non-limiting embodiment, provided is a computer-implemented method of transforming movement authority limits for a train traveling in a track network, including: determining authority associated with a switch leg, a first track segment including a point of switch, and a second track segment based at least partially on authority data and/or train authority data, wherein the first track segment is adjacent to the switch and the second track segment is adjacent to a switch leg of the switch, such that the switch and the switch leg are located between the first track segment and the second track segment; and providing authority on the switch leg based at least partially on the authority associated with the switch leg, the first track segment, and the second track segment.

In another preferred and non-limiting embodiment, provided is a computer-implemented method of transforming movement authority limits for a train traveling in a track network, including: determining authority associated with a first track segment located on a first track, a second track segment located on a second track, and a switch leg of a switch located on the first track based at least partially on authority data and/or train authority data, wherein the first track segment and the second track segment are located at opposite ends of a crossover track between the first track and the second track; and providing authority on the crossover track based at least partially on the authority associated with the first track segment, the second track segment, and the switch leg.

In another preferred and non-limiting embodiment, provided is a computer-implemented method of transforming movement authority limits for a train traveling in a track network, including: determining authority associated with a track segment, and a first switch leg of a switch based at least partially on authority data and/or train authority data, wherein the track segment is adjacent to the switch, such that the switch is located between the track segment and the first switch leg; and providing authority on a second switch leg based at least partially on the authority associated with the track segment and the first switch leg.

In a further preferred and non-limiting embodiment, provided is a computer-implemented method of transforming movement authority limits for a train traveling in a track network, including: determining authority associated with a switch leg, a first track segment including a point of switch, and a second track segment based at least partially on authority data and/or train authority data, wherein the first track segment is adjacent to the switch and the second track segment is adjacent to a switch leg of the switch, such that the switch and the switch leg are located between the first track segment and the second track segment; and providing authority on the switch leg based at least partially on the authority associated with the switch leg, the first second track segment, and the second track segment, wherein the steps of determining and providing are performed by a management system on the train traveling in the track network In a still further preferred and non-limiting embodiment, provided is a computer-implemented method of transforming movement authority limits for a train traveling in a track network, including: receiving authority data in a single authority dataset message; determining authority associated with a first track segment located on a first track, a second track segment located on a second track, and a switch leg of a switch located on the first track based at least partially on the authority data provided in the single authority dataset message, wherein the first track segment and the second track segment are located at opposite ends of a crossover track between the first track and the second track; and providing authority on the crossover track based at least partially on the authority associated with the first track segment, the second track segment, and the switch leg, in response to receiving the single authority dataset message that contains authority for at least a portion of the first track segment, at least a portion of the second track segment, and at least a portion of the switch leg.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
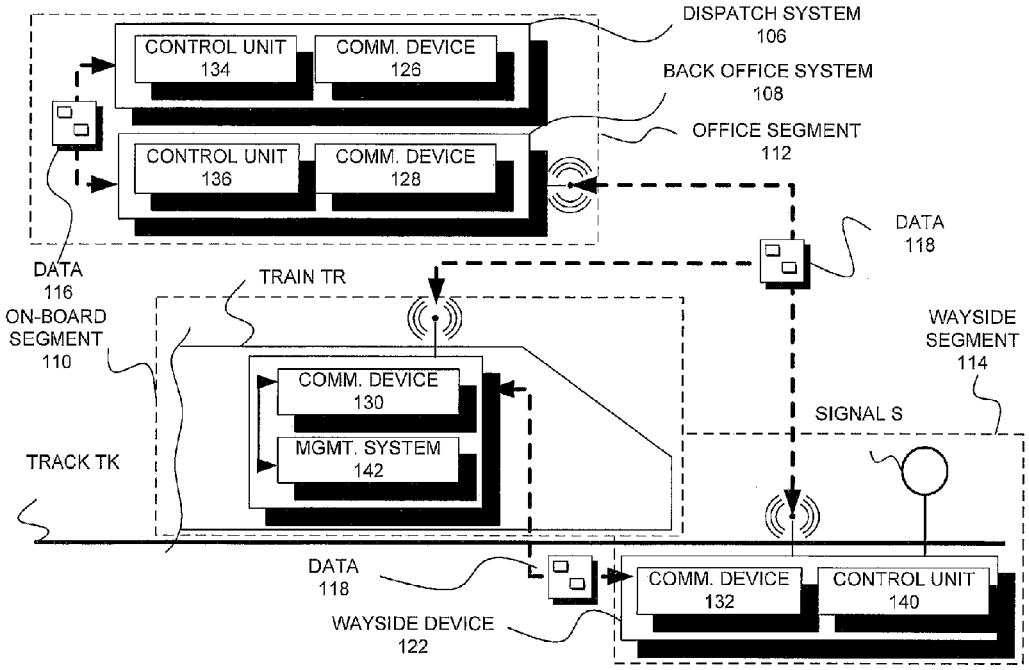
FIG. 1 is a schematic view of one non-limiting exemplary embodiment of the system and method for transforming movement authority limits according to the principles of the present invention.

For purposes of the description hereinafter, the terms "end," "upper," "lower," "right," "left," "vertical," "horizontal," "top," "bottom," "lateral," "longitudinal," and derivatives thereof shall relate to the various embodiments as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply non-limiting exemplary embodiments of the invention. Hence, specific dimensions and other physical characteristics related to the embodiments disclosed herein are not to be considered as limiting.

The present invention may be implemented on one or more computers, computing devices, or computing systems. Such computers may include the necessary hardware, components, internal and external devices, and/or software to implement one or more of the various steps and processes discussed hereinafter, including, but are not limited to, data capture, processing, and communication in a network environment. Further, one or more of the computers of the computing system may include program instructions and/or particular, specialized programs to effectively implement one or more of the steps of the present invention. Still further, one or more of the modules or portions of these program instructions (or code) can be stored on or implemented using known articles and physical media.

The present invention is directed to a system and method of transforming authority limits that can be used in connection with multiple railway vehicles traversing on one or more tracks. In addition, the present invention may be implemented in an office segment and/or an on-board segment. Still further, the present invention may be implemented in connection with any of the known operations of railway vehicles, such as freight operations, commuter operations, repair operations, service operations, and the like. In addition, the present invention is equally useful in conventional fixed block signal systems, moving block systems, communications-based train control systems, non-signal territory, PTC systems, and/or existing on-board control systems such as, for example, Advanced Civil Speed Enforcement System (ACSES) developed by PHW and ALSTOM, Interoperable-Electronics Train Management System (I-ETMS) and/or Vital-Electronics Train Management System (V-ETMS) developed by WABTEC.

It should be recognized that the use of the term "control unit" hereinafter may refer to any specially-programmed and/or configured general-purpose computing device having the appropriate and known components. For example, such a "control unit" may include computer-readable storage media, a central processing unit (or microprocessor), and may be operatively coupled to one or more communication devices, and other individual devices and mechanisms for receiving, processing, and/or transmitting information and data. For example, in one non-limiting exemplary embodiment, the system and method of transforming movement authority limits may include one or more control units that are integrated with existing back office systems, dispatch systems, wayside devices, or other computing device(s) associated with train control, whether locally or at some centralized location.

Exemplary computer-readable storage media may include, but are not limited to, random-access memory (RAM), dynamic RAM (DRAM), Double-Data-Rate DRAM (DDRAM), synchronous DRAM (SDRAM), static RAM (SRAM), read-only memory (ROM), programmable ROM (PROM), erasable programmable ROM (EPROM), electrically erasable programmable ROM (EEPROM), flash memory (e.g., NOR or NAND flash memory), content addressable memory (CAM), polymer memory (e.g., ferroelectric polymer memory), phase-change memory, ovonic memory, ferroelectric memory, silicon-oxide-nitride-oxide-silicon (SONOS) memory, magnetic or optical cards, or any other suitable type of computer-readable storage media in accordance with the described embodiments and/or implementations.

It should be further recognized that use of the term "processing unit" or "central processing unit" may refer to any to any specially-programmed and/or configured device that is capable of performing arithmetic, logical, and/or input/output operations. The "processing unit" may be implemented in hardware such as, for example, in a Field Programmable Gate Array (FPGA), a Programmable Logic Array (PLA), a Complex Programmable Logic Device (CPLD), a Programmable Array Logic (PAL) or any other programmable hardware device. Alternatively, the "processing unit" may be implemented in software, such as, for example, in a virtual machine. Additionally, in some implementations, the "processing unit," may be further programmed and/or configured by a set of instructions into a specially-programmed and/or configured device. For example, the "processing unit" may be implemented using a general-purpose device such as, for example, a general-purpose processor capable of executing a set of instructions that programs and/or configures the general-purpose processor into a specially-programmed and/or configured device.

It should also be recognized that the use of the term "communication device" hereinafter may refer to any specially programmed or configured device for receiving, processing, and/or transmitting information or data over one or more mediums and having the appropriate and known components. Thus, in various non-limiting exemplary embodiments, a "communication device" may include one or more controllers operatively coupled to one or more antennas configured to transmit information or data over the air. Additionally, in various non-limiting exemplary embodiments, the "communication device" may also include one or more controllers operatively coupled to one or more physical connections configured to transmit information through the rail and/or cables. Further, in various non-limiting exemplary embodiments, the system and method of transforming movement authority limits may include one or more communication devices that are integrated with an on-board management system, back office systems, dispatch systems, wayside devices, or other computing device(s) associated with train control which may require communication with other systems and/or devices, whether locally or at some centralized location.

In one or more non-limiting exemplary embodiments, the "communication device" may include, but is not limited to, a communications management unit programmed and/or configured to facilitate communications between other communication devices via one or more wireless networks and/or wired networks. The one or more wireless networks may include, but is not limited to, VHF/UHF Data Radio, 220 MHz PTC Radios, 900 MHz Advanced Train Control System (ATCS) Radio Code Line, Wi-Fi networks based on IEEE 802.11 standards, Satellite networks, and cellular networks based on GSM standards, WiMAX standards, TDMA standards, CDMA standards, International Mobile Telecommunications-2000 (IMT-2000) specifications, International Mobile Telecommunications-Advanced (IMT-Advanced), LTE standard, or any other cellular/wireless standard that supports transmission of voice and/or data over a geographic location. It will be appreciated that in at least some embodiments, the "communication device" may further include, but is not limited to, wired networks based on Ethernet IEEE 802.3 standards over coaxial, twisted pair, fiber optics, or any other physical communication interfaces. It will also be appreciated that in other non-limiting embodiments, the wireless networks may include, but are not limited to, communications via inductive loop and/or transponders and the wired networks may include communications via track circuits.

It should be still further recognized that while various embodiments discussed herein may refer to various elements such, as for example, various data, systems, units, devices, and/or interfaces with reference to only a limited number for such elements, it will be appreciated that these elements may be more or less as desired for a particular implementation. For example, a particular implementation may require certain elements to have a very low probability of undetected failures i.e. vital or safety-critical elements. In that particular implementation, the vital elements may be designed in accordance with safety oriented design standards and may include redundant or duplicate hardware components, software components, and/or data components, in the event that one or more components degrade, fail, or become corrupted. To harmonize the operation of various redundant hardware components, software components, and/or data components, measurements, calculations, and/or determinations made by these components or stored by these components may be aggregated, such, as for example, by using a majority voting system and/or averaging system in accordance with a desired implementation. In other implementations, the elements themselves may be in duplicate and harmonized using a majority voting system and/or averaging system in accordance with a desired implementation.

It should be further recognized that use of the term "normal leg" of a switch or turnout discussed herein may refer to the straight track or lead track on a main track, and the term "reverse leg" may refer to the diverging track or the spur track that connects main tracks or connects a main track to a siding track. It will be appreciated that these terms may vary or may be interchanged based on the configuration of switches or turnouts at different locations of the track in a track network. Accordingly, discussions and use of these terms herein are merely for illustration purposes, and are not intended to limit any of the embodiments or implementations.

A preferred and non-limiting embodiment of the system and method of transforming movement authority limits is illustrated in FIG. 1. In particular, the system and method may include, but is not limited to, an On-Board Segment 110, an Office Segment 112, and a Wayside Segment 114. The On-board Segment 110 may include, but is not limited to, a Management System 142 operatively coupled to a Communication Device 130 to facilitate the operation and/or movement of a Train TR traveling on a Track TK in a track network. Exemplary management systems may include, but are not limited to, I-ETMS and V-ETMS developed by WABTEC.

The Office Segment 112 may include, but is not limited to, a Dispatch System 106 programmed and/or configured to provide and/or issue movement authorities to the On-Board Segment 110 of at least one Train TR operating on Track TK in a track network, and a Back Office System 108 programmed and/or configured to provide interoperability and logistics support of the Train TR operating on Track TK in the track network. Exemplary Dispatch System 106 may include, but is not limited to, a computer aided dispatch system, a central dispatch system, or any other system that facilitates the communication and/or safe operation of railway vehicles in a track network.

In a non-limiting exemplary implementation, the Dispatch System 106 may include, but is not a limited to, a Control Unit 134 programmed and/or configured to facilitate the safe operation of multiple railway vehicles and a Communication Device 126 programmed and/or configured to facilitate communications with the Back Office System 108, Wayside Segment 114 and/or On-Board Segment 110 of Train TR traveling in a track network. Multiple, discrete communication devices may be used to facilitate such communications directly or indirectly to the Back Office System 108, the Wayside Segment 114 and/or the On-Board Segment 110. It will be appreciated that while a non-limiting exemplary implementation of a dispatch system is illustrated in FIG. 1, the implementation of dispatch systems may vary among various railroad operators.

Accordingly, in order to provide interoperability with various dispatch systems and logistics support for multiple railway vehicles operating across multiple railroad operators, the Dispatch System 106 may be communicatively coupled via the Communication Device 126 to a Back Office System 108. Exemplary Back Office System 108 may include, but is not limited to, Electronics Train Management System (ETMS) Back Office Server developed by WABTEC. In one non-limiting exemplary implementation, the Back Office System 108 may include, but is not a limited to, a Control Unit 136 programmed and/or configured to execute at least one back office server instance or function and transform and normalize data received from the Dispatch System 106; and a Communication Device 128 communicatively coupled to the Dispatch System 106, On-board Segment 110 and/or Wayside Segment 114. Multiple, discrete communication devices may be used to facilitate such communications directly or indirectly to the Dispatch System 106, the On-Board Segment 110 and/or the Wayside Segment 114. Additionally, the Back Office System 108 may be programmed and/or configured to facilitate communications between the Dispatch System 106 and the On-Board Segment 110 of Train TR and support the operation of the Train TR traveling on Track TK in a track network. Further, the Back Office System 108 may also be programmed and/or configured to facilitate communications between the Dispatch System 106 and the Wayside Device 122. It will be appreciated that while a non-limiting exemplary implementation of a back office system is illustrated in FIG. 1, the implementation of back office systems may vary among railroad operators and may vary depending upon the geographical region the back office system is designed to support.

In operation, the Dispatch System 106 may issue or provide movement authority to one or more railway vehicles (and/or to the crew or work crew, such as in the form of a permission to occupy a section of the Track TK (e.g., a "track authority")) operating on one or more tracks in a track network and may be programmed and/or configured to receive, generate, and/or provide Data 116 to the Back Office System 108. Data 116 may include, but is not limited to, Authority Data and/or Track Data. The Authority Data 116 may include the authority limits for Train TR, traveling on Track TK in a track network. Moreover, the authority limits may be provided to the Back Office System 108 in one or more authority dataset messages and may be identified by one or more track names and dispatchable points. Exemplary dispatchable points may include mileposts, station signs, timetable locations, or any other clearly identifiable points that may be used by a dispatch system to define the limit of a mandatory directive. In addition, it will be appreciated that Authority Data may further include, but is not limited to, speed restrictions, time restrictions, and/or direction of travel, associated with authority limits of a railway vehicle. Furthermore, depending upon the implementation of the Dispatch System 106, the Authority Data provided to the Back Office System 108 may also include authority limits for switch legs of switches or crossover tracks.

The Track Data may include, but is not limited to, data points and fields relating to the infrastructure and various aspects of tracks in one or more track networks. The infrastructure and various aspects may include, but are not limited to, signals, switches, clearance points, crossings, track classes, quiet zones, bit assignment for wayside communications, permanent speed restrictions, and/or interlocking/control points. Additionally, it will be appreciated that the Track Data may be stored in a computer-readable storage media and organized in a variety of data structures or data formats.

Exemplary data structures may include, but are not limited to databases, arrays, lists, vectors, maps, heaps, sets, or any other structure programmed and/or configured for storage and retrieval of data. Exemplary data formats may include, but are not limited to the PTC Data Model format, and/or Subdivision Track Data format. It will be appreciated that in some implementations, the Office Segment 112 may provide, store, and/or process authority limits based on one track data format, such as, for example, the PTC Data Model format, while the On-Board Segment 110 of a railway vehicle, may be programmed and/or configured to receive, store, and/or process a different track data format, such as, for example, Subdivision Track Data format.

In one non-limiting exemplary implementation, the Back Office System 108 may be configured to receive Authority Data and/or Track Data from the Dispatch System 106 and store the received Authority Data and/or Track Data in a computer-readable storage media operatively coupled to the Back Office System 108. In particular, the Back Office System 108 may be programmed and/or configured to execute one or more instances or functions of Back Office Server and each Back Office Server instance or function may be programmed and/or configured to facilitate communications between the Office Segment 112 and the On-Board Segment 110. In some implementations, the one or more instances or functions of the Back Office System 108 may be programmed and/or configured to normalize Data 116, including Track Data and/or Authority Data, received from Dispatch System 106, such that the Data 118, transmitted from the Back Office System 108 to the On-Board Segment 110 may be programmed and/or configured for processing by the On-Board Segment 110. It will be appreciated that in some implementations, the normalization of Data 116 may not modify the information contained in Data 116 but may only change the format of Data 116 such that the Data 118 may be compatible with or accessible by the On-Board Segment 110 of Train TR. Thus, Data 118 may further include, but is not limited to, normalized Authority Data, and/or normalized Track Data.

In other implementations, the Back Office System 108 may not be programmed and/or configured to normalize Data 116 received from the Dispatch System 106 before transmitting the Data 118 to the On-Board Segment 110. Accordingly, it will be appreciated that references to Authority Data and/or Track Data may also include normalized Authority Data and/or normalized Track Data unless normalized Authority Data and/or normalized Track Data is explicitly referenced. Additionally, it will be appreciated that Data 118, regardless of any normalization performed by the Back Office System 108, may be transmitted directly or indirectly to the On-Board Segment 110. Moreover, in an indirect transmission, the Data 118 may be first transmitted to the Wayside Segment 114 that is programmed and/or configured to receive, store, and retransmit Data 118 to the On-Board Segment 110 of a Train TR using one or more wireless and/or induction based communication standards or track circuits.

To facilitate the transformation of movement authority limits to a smaller divisions of track so that multiple rail vehicles may safely operate on the same track, the Back Office System 108 may be further programmed and/or configured to transform the Authority Data, which may include authority limits identified by one or more track names and dispatchable points to Train Authority Data, which may include sequences of blocks and offsets for one or more railway vehicles traveling on one or more tracks in a track network. In particular, the Back Office System 108 may be programmed and/or configured to determine the number of authority segments provided by the Dispatch System 106 in one or more authority dataset messages. Additionally for each authority segment, the Back Office System 108 may be programmed and/or configured to identify a sequence or a list of blocks within each authority segment beginning with a first dispatchable point, such as, for example, a "Starting Milepost" and traverse to a second dispatchable point, such as, for example, an "Ending Milepost." In one non-limiting exemplary implementation, if the "Starting Milepost" or "Ending Milepost" is located at the Starting Offset or Ending Offset of a block, then that limit will also be identified in the Starting Offset or Ending Offset of an adjacent block.

In one preferred and non-limiting embodiment, the Back Office System 108 calculates a "Track Limit CRC" over a set of blocks and offsets. The On-Board Segment 110 then obtains or determines the same set of blocks and offsets, and calculates the same CRC in order to verify or confirm that the Back Office System 108 has processed the authority correctly and/or consistently. Further the Back Office System 108 and/or the On-Board Segment 110 is programmed or configured to determine and analyze the blocks that should be included in the set, and determine or resolve any ambiguities in the blocks, offsets, and/or authorities directed thereto.

In some non-limiting exemplary embodiments discussed herein, the Back Office System 108 may be further programmed and/or configured to add switch legs or crossover tracks to provide authority between tracks for one or more railway vehicles. In particular, the Back Office System 108 may be programmed and/or configured to add a switch leg of a switch or a crossover track and any associated track between designated points on one or more tracks and/or switch legs to Authority Data and/or Train Authority Data for a train within the jurisdiction of the Back Office System 108. The designated point may include, but is not limited to, a point of switch, and/or a clearance point.

To ensure that multiple railway vehicles may safely operate on the same track, the Back Office System 108 may be further programmed and/or configured to perform authority conflict checking by comparing the transformed authority limits, e.g., the Train Authority Data for a train against authority limits of other train(s) to ensure that there are no conflicting authority limits between that train and other trains that may result in collisions on the track. Thus, in one non-limiting exemplary implementation, the Back Office System 108 may be programmed and/or configured to compare the sequence or list of blocks contained in the Train Authority Data for a train with the sequence or list of blocks in the Train Authority Data for other trains to determine whether there is a conflict of authority or an overlap in authority between the trains. However, it should be recognized that these transformations and checks are not limited to an authority granted to a train. In one preferred and non-limiting embodiment, the Back Office System 108 transforms authority data received from the Dispatch System 106 and checks for conflicts among all types of authorities granted; not only the authority granted to the Trains TR. For example, a movement authority granted to a Train TR could overlap an existing track authority granted to a work crew. Conversely, a track authority granted to a work crew could overlap an existing movement authority granted to a Train TR. It should be noted that the terminology varies based upon which authority was granted first (i.e., the "new" authority is judged against all "existing" authorities.) Since all types of authorities can be transformed and checked, the term "Train Authority Data" can be used to designate any type of authority utilized, generated, issued, and/or received within the system.

To ensure that the Authority Data has been properly transformed into Train Authority Data so that conflicts or overlaps are properly detected, the Back Office System 108 may be further programmed and/or configured to perform at least a portion of transformation checking by calculating Hash Data based on the Train Authority Data in accordance with one or more hash functions. The Train Authority Data may include, but is not limited to, at least one authority segment and at least one block for each authority segment. Moreover, each block may include at least one block data field. In particular the at least one block data field may include, but is not limited to, (1) a Standard Carrier Alpha Code (SCAC) field, (2) a Subdivision/District ID, (3) a Block ID, (4) a Starting Offset, (5) Ending Offset, or any combination thereof. Further, the Back Office System 108 may be programmed and/or configured to calculate the Hash Data based on a particular order or sequence of the authority segments, blocks, and data fields contained in the Train Authority Data. Thus, in one non-limiting exemplary implementation, the Back Office System 108 may be programmed and/or configured to calculate Hash Data in accordance with a hash function starting from block data field (1) to block data field (5) and repeat the computation for each block within each authority segment contained in the Train Authority Data. It will be appreciated that the one or more hash functions, may include, but are not limited to, Checksums, Cyclic Redundancy Check (CRC), MD5 Message Digest, SHA-1 Message Digest, or any other algorithm that maps input data of variable length to hash data of fixed length, such that a comparison can be made to determine the integrity of the input data. Once the Hash Data is calculated, the Back Office System 108 may be further programmed and/or configured to transmit the Hash Data to the On-Board Segment 110. Thus, Data 118 may further include, but is not limited to, Hash Data. In another preferred and non-limiting embodiment, the Back Office System 108 does not create the hash if the data is not to be sent to the On-Board Segment 110. Further, and in this embodiment, since the Back Office System 108 has expanded visibility (i.e., all authority granted within a subdivision), it can transform all authorities and check for conflicts among them. Still further, it should be recognized that a set or subset of the authorities are granted to Trains TR (as opposed to being granted to crew and/or equipment), such that a hash created and sent to the corresponding On-Board Segment 110. Accordingly, in one preferred and non-limiting embodiment, each On-board Segment 110 has visibility only to the authorities granted specifically to it, such that it can only check the hash (e.g., it cannot check for conflicts since it does not have visibility to authorities granted to other entities).

Additionally, in some implementations, the Back Office System 108 may be programmed and/or configured to perform at least a portion of the transformation checking without or before adding any switch legs and/or crossover tracks to Authority Data and/or Train Authority Data. In other implementations, Back Office System 108 may be programmed and/or configured to perform at least a portion of the transformation checking after adding one or more switch legs or crossover tracks. Furthermore, in some implementations, when the "Starting Milepost" or "Ending Milepost" is located at the Starting Offset or Ending Offset of a block, then that limit which may also be identified in the Starting Offset or Ending Offset of an adjacent block may not be included in the Hash Data calculation in order to eliminate adding an additional block to the sequence or list of blocks that represents a duplicate milepost.

It will be appreciated that in some implementations, the Dispatch System 106 may also be programmed and/or configured to facilitate transformation of movement authority limits, authority conflict checking, and transformation checking. Accordingly, in such implementations, the Dispatch System 106 may be communicatively coupled to On-Board Segment 110 and/or the Wayside Segment 114 in order to directly or indirectly provide the Authority Data, the Hash Data, and/or the Track Data to the On-Board Segment 110. Additionally, in some implementations, the Dispatch System 106 may also programmed and/or configured to normalize the Authority Data, Track Data, and/or Hash Data as necessary before transmission, either directly or indirectly, to the On-Board Segment 110.

In some territories, Track TK may include a Wayside Segment 114 to facilitate safe operation of multiple railway vehicles on Track TK. In a non-limiting exemplary implementation, the Track TK may include a Wayside Device 122 and/or a Signal S operatively coupled to the Wayside Device 122 that is positioned along the tracks. In one non-limiting exemplary implementation, the Wayside Device 122 may include, but is not limited to, a Communication Device 132, and a Control Unit 140 operatively coupled to the Communication Device 132. Exemplary wayside devices may include, but is not limited to, a track circuit device, transponder device, switch device, and/or signal device. Furthermore, the Wayside Device 122 may be programmed and/or configured to transmit status of switches and/or signals as Signal Data to the On-Board Segment 110 of Train TR via Communication Device 132. Accordingly, it will be appreciated that Data 118, in addition to Track Data, Authority Data, and Hash Data, may further include, but is not limited to, Signal Data transmitted from the Wayside Segment 114 to the On-Board Segment 110. As previously discussed with respect to some implementations, the Wayside Device 122 may be programmed and/or configured to receive and store Data 118 from the Office Segment 112 and/or internal Signal Data in a computer readable storage media for transmission to a Train TR traveling on the Track TK.

To enforce movement authority limits and signals positioned along the track for one or more railway vehicles, the On-Board Segment 110 of Train TR, may include, but is not limited to, a Communication Device 130 and a Management System 142 operatively coupled to the Communication Device 130. In one non-limiting exemplary implementation, the Communication Device 130 may be programmed and/or configured to communicate with the Office Segment 112 including, but is not limited to, the Dispatch System 106, the Back Office System 108, and the Wayside Segment 114, including, but is not limited to, Wayside Device 122. In particular, the Management System 142 may be programmed and/or configured to receive via the Communications Device 130, Data 118, including Authority Data, Hash Data, Track Data, and/or Signal Data. Furthermore, the Management System 142 may be programmed and/or configured to store Data 118 in a Computer-Readable Storage media and process the received and/or stored Data 118.

Figure 2:
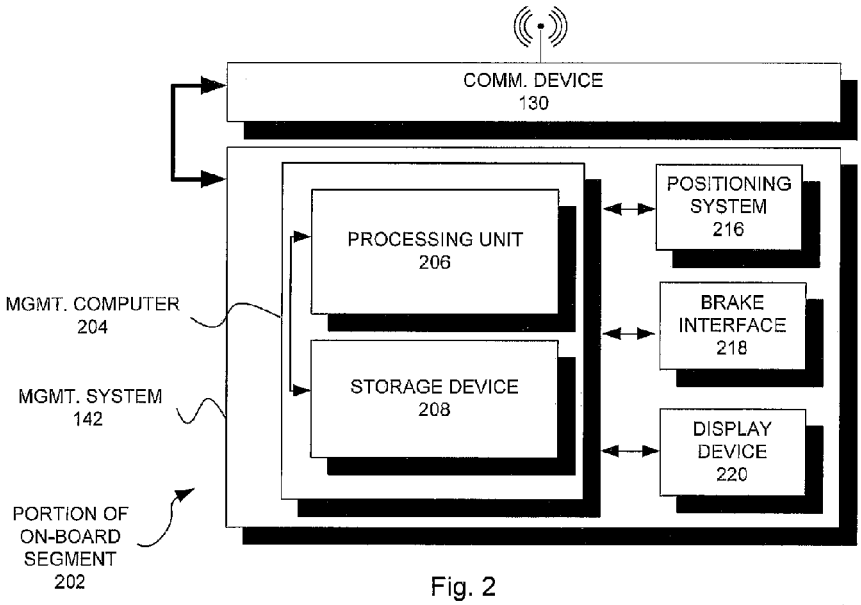
FIG. 2 is a schematic view of one non-limiting exemplary embodiment of a portion of an on-board segment in the system and method for transforming movement authority limits according to the principles of the present invention.

FIG. 2 illustrates at least a portion of the On-board Segment 110 of Train TR. As previously discussed, a portion of On-Board Segment 202 may include, but is not limited to a Communication Device 130 operatively coupled to the Management System 142. The Management System 142 may include, but is not limited to, a Management Computer 204 operatively coupled to a Positioning System 216, a Brake Interface 218, and a Display Device 220. Additionally, in some implementations, at least the Management System 142 of the On-Board Segment 110 may be considered a vital or fail-safe element.

The Management Computer 204 may be operatively coupled to a Positioning System 216 programmed and/or configured to determine the Position Data regarding the location of the Train TR in a track network. The Position Data may include, but is not limited to, Location Data, Velocity Data, and/or Time Data. Exemplary position systems may include, but is not limited to, Global Positioning System (GPS), Assisted GPS (A-GPS), or any other positioning system programmed and/or configured to determine and provide Position Data of Train TR traveling in the track network. Alternatively, the Management Computer 204 may also be operatively coupled to the Communication Device 130 and programmed and/or configured to determine the Position Data based on site-specific data received from one or more transponders positioned along the tracks as the Train TR traverses the tracks in a track network.

The Management Computer 204 may be operatively coupled to a Brake Interface 218 programmed and/or configured to provide Brake Data to engage a Brake System (not shown) in order to slow and/or stop the Train TR in accordance with the Brake Data. In operation, the Management Computer 204 may determine the Brake Data, based at least partially, on the Operator Input Data, Position Data, Signal Data, Transformed Authority Data, Track Data, and/or Hash Data, and transmit the determined Brake Data to the Brake Interface 218 in order to engage the Brake System operatively coupled to the Brakes (not shown) of the Train TR. One exemplary Brake System may include, but is not limited to FASTBRAKE Electronic Air Brake developed by WABTEC.

The Management Computer 204 may be further operatively coupled to a Display Device 220 programmed and/or configured to display warnings, Authority Data, Hash Data, Operator Input Data, Position Data, Signal Data, Track Data, and/or Train Authority Data. Additionally, in some implementations, the Display Device 220 may be operatively coupled to an Input Device (not shown) so that an engineer or operator of the Train TR may provide input to the Management Computer 204. Moreover, the Input Device may transmit Operator Input Data to the Management Computer 204 based at least partially on the received operator or engineer input. It will be appreciated that in some implementations, the Input Device may be integrated with the Display Device 220 such as, for example, in configurations where the Display Device 220 may be a touch screen device. Accordingly, in these implementations, the Management Computer 204 may be programmed and/or configured to receive the Operator Input Data from the Input Device integrated with the Display Device 220. Still in other implementations, the Management Computer 204 may be further programmed and/or configured to receive Operator Input Data from both an external Input Device and the Display Device 220 that includes an integrated Input Device.

The Management Computer 204 may further include, but is not limited to, a Processing Unit 206 operatively coupled to a Storage Device 208 configured and/or adapted to store Authority Data, Hash Data, Operator Input Data, Position Data, Signal Data, Track Data, and/or Train Authority Data in one or more computer-readable storage mediums. Additionally, the Management Computer 204 may be programmed and/or configured to calculate and/or process in soft, firm, or hard real-time the Authority Data, Hash Data, Operator Input Data, Position Data, Signal Data, Track Data, and/or Train Authority Data as necessary for various embodiments and/or implementations discussed herein.

In order to facilitate the transformation of movement authority limits into smaller divisions of track such as, for example, a sequence of blocks and offsets, the Management System 142 including, but is not limited to, the Management Computer 204 may be further programmed and/or configured to transform Authority Data to Train Authority Data. In particular, the Management System 142 may be programmed and/or configured to determine the number of authority segments provided by the Back Office System 108 in one or more authority dataset messages. Additionally for each authority segment, the Management System 142 may be programmed and/or configured to identify a sequence of blocks within each authority segment beginning with a first dispatchable point, such as, for example, a "Starting Milepost" and traverse to a second dispatchable point, such as, for example, an "Ending Milepost." In one non-limiting exemplary implementation, if the "Starting Milepost" or "Ending Milepost" is located at the Starting Offset or Ending Offset of a block, then that limit will also be identified in the Starting Offset or Ending Offset of an adjacent block.

Additionally, the Management System 142 of Train TR may be programmed and/or configured to add switch legs or crossover tracks to provide authority between tracks for Train TR. In particular, the Management System 142 may be programmed and/or configured to add a switch leg of a switch or crossover track and any associated track between designated points on one or more tracks and/or switch legs. The designated points may include, but are not limited to, a point of switch and/or a clearance point on the track and/or switch leg associated with the switch.

To ensure the proper transformation of Authority Data to Train Authority Data, the Management System 142 may be further programmed and/or configured to perform transformation checking by calculating Hash Data based on the Train Authority Data in accordance with one or more hash functions. Similar to the Back Office System 108, the Management System 142 may also be programmed and/or configured to calculate the Hash Data based on a particular order of the data contained in the Train Authority Data for each block within each authority segment. Furthermore, the Management System 142 may be programmed and/or configured to verify the Train Authority Data transformed by the Management System 142 with the Train Authority Data transformed by the Office Segment 112, such as, for example, the Train Authority Data transformed by the Back Office System 108.

The Management System 142 may be programmed and/or configured to receive and store the Hash Data calculated by Office Segment 112 based on the Train Authority Data transformed by the Office Segment 112. The Management System 142 may be further programmed and/or configured to compare the Hash Data (e.g., CRC) calculated by the Office Segment 112 with the Hash Data calculated by the Management System 142 and determine whether a transformation error and/or inconsistency occurred. In a non-limiting exemplary implementation, when the Management System 142 determines that the calculated Hash Data for the Train Authority Data transformed by the Management System 142 does not match the calculated Hash Data for the Train Authority Data transformed by the Back Office System 108, the Management System 142 may be programmed and/or configured to execute at least one action.

It will be appreciated that in some implementations of the non-limiting embodiment of FIG. 2, the Management System 142 may be programmed and/or configured to perform transformation checking without or before adding any switch legs or crossover tracks. In such implementations, the Management System 142 may calculate the Hash Data based on the Train Authority Data before adding switch legs or crossover tracks to the Train Authority Data. In such implementations, the Office Segment 112 may also be programmed and/or configured to calculate Hash Data based on the Train Authority Data without or before adding switch legs or crossover tracks to the Train Authority Data.

It will be appreciated that in other implementations of the non-limiting embodiment of FIG. 2, the Management System 142 may be programmed and/or configured to perform the transformation checking after adding one or more switch legs or crossover tracks to Authority Data and/or Train Authority Data. In such implementations, the Management System 142 may be programmed and/or configured to calculate the Hash Data based on the Train Authority Data after adding switch legs or crossover tracks to the Authority Data and/or Train Authority Data. Furthermore, in such implementations, the Office Segment 112 may also be programmed and/or configured to calculate Hash Data based on the Train Authority Data after adding one or more switch legs or crossover tracks to Authority Data and/or the Train Authority Data. Regardless of the implementation, it will be appreciated that the transformation of Authority Data to Train Authority Data and the calculation of Hash Data based on the Train Authority Data by the Management System 142 may substantially match or mirror those performed by the Office Segment 112 in order to reduce or avoid any unintended transformation errors, when the Train Authority Data transformed by the Management System 142 is verified against Train Authority Data transformed by the Office Segment 112.

When the verification of the Train Authority Data indicates that no transformation error and/or inconsistency has occurred, the Management System 142 may be programmed and/or configured to adopt the Train Authority Data, so that the authority limits for the On-Board Segment 110 of the Train TR includes at least a portion of the track identified by the Train Authority Data. However, when the verification of the Train Authority Data indicates a transformation error, the Management System 142 may be programmed and/or configured to discard the Train Authority Data.

To further ensure the safety of one or more railway vehicles operating in the track network and as previously discussed, the Management System 142 may be further programmed and/or configured to perform or execute at least one action, when the verification indicates a transformation error and/or inconsistency. The at least one action, may include, but is not limited to, outputting a visual warning to the Display Device 220, prompting for acknowledgment by the operator or engineer via an Input Device, and/or providing an audible warning to an Audio Device (not shown) in order to gain vigilance of the operator or engineer and proceed based on authority from a dispatch system or input via the Input Device from the operator or engineer. It will be appreciated that the at least one action may further include, but is not limited to notifying the Office Segment 112, which may include, but is not limited to, the Back Office System 108 and/or the Dispatch System 106 regarding the transformation error. Two examples of such transformation errors and/or inconsistencies include, but are not limited to: identification of an issue with the transformation (e.g., the Management Computer 204 encounters an issue completing the transformation on its own); and a consistency check (e.g., the Management Computer 204 compares the hash that it calculated with the hash provided by the Office Segment 112.

In cases when Management System 142 failed to gain vigilance of the operator or engineer, the Management System 142 and in particular, the Management Computer 204 may be programmed and/or configured to transmit Brake Data to the Brake Interface 218 in order to slow and/or stop the Train TR, when the operator or engineer failed to provide authority to the Management System 142 via the operator's or engineer's input using the Input Device or the Management System 142 failed to receive PSS form-based authority. It is to be understood that "PSS" refers to "Pass Signal at Stop," where the control operator or dispatcher may give authority for a train TR to pass a signal displaying a "stop" indication either verbally (which the crew relays to the On-Board Segment 110 via a key press) or electronically in a PSS form-based authority (which the On-Board Segment 110 receives directly from the Back Office System 108). It will be appreciated that the Management Computer 204 may be programmed and/or configured to transmit Brake Data to the Brake Interface 218, such that the Train TR is stopped before it enters or moves onto a portion of the track that the On-Board Segment 110 of the Train TR does not hold authority to travel on or near.

In some implementations and as previously discussed, the Track Data may include but is not limited to, clearance points associated with switches or turnouts along the track which may be stored in a variety of data formats including, but is not limited to, the PTC Data Model format and/or the Subdivision Data format. In particular, before transmission of Track Data to the On-Board Segment 110 of Train TR, a Geographical Information System (GIS) (not shown), and/or the Office Segment 112 (e.g., the Dispatch System 106 and/or the Back Office System 108) may be programmed and/or configured to identify, place, and/or generate clearance points for one or more switches on one or more tracks that a railroad operator may have control. Additionally, the GIS and/or Office Segment 112 may be further programmed and/or configured identify, place, and/or generate clearance points for any switches that may adjoin the tracks under the railroad operator's control.

Moreover, a railroad operator or a third party may be in possession and/or control of a GIS operatively coupled to the Office Segment 112. In particular, the GIS may contain the necessary hardware and/or software that are capable of being programmed and/or configured to capture and store the infrastructure and various aspects of tracks in one or more track networks. The infrastructure and various aspects of tracks surveyed by the railroad operator using the GIS may be stored as GIS Data. Additionally, the GIS may be programmed and/or configured to analyze, verify, update, manipulate, and/or manage the stored GIS Data and convert the GIS Data into Track Data. During the conversion process, the GIS may also identify, place, and/or generate clearance points in the Track Data for consumption or use by the Office Segment 112 and/or the On-Board Segment 110. It will be appreciated that in other non-limiting exemplary implementations, the Office Segment 112 may also be programmed and/or configured to perform similar functions discussed above with respect to the GIS, which may include, but is not limited to, updating, identifying, placing, and/or generating clearance points, for new and/or existing track features captured by a railway vehicle traversing a track network.

In some implementations, each clearance point placed and/or generated in the Track Data by the GIS and/or Office Segment 112 may be associated with Clearance Point Data containing one or more entries or fields. In particular, the one or more entries or fields may include, but is not limited to, a Switch ID which references the switch identified by the Switch ID to which this clearance point applies, a Subdivision/district ID or Sub ID which provides the subdivision containing the referenced switch, a Railroad SCAC which provides the railroad SCAC field for the railroad containing the referenced switch, an Offset which contains the offset of the clearance point from the beginning of a block in feet, a Switch Leg which specifies which switch leg the offset distance applies to (i.e., normal leg/reverse leg), a Clearing Type, which specifies the type of this clearance point (i.e., non-clearing or not applicable/electric lock/signal in lieu of electric lock), a Track Verify ID which uniquely identifies the feature during verification, or any combination thereof.

The identification, placement, and/or generation of clearance points in the Track Data may assist in providing fouling protection near switches or turnouts, especially when clearance points may not be clearly marked or visible in the field. The placement of clearance points may also ensure that the On-Board Segment 110 of Train TR, identifies, places, and enforces one or more targets to gain the operator's or engineer's vigilance at appropriate locations and/or situations or ensure that Train TR advances beyond one or more targets only if the On-Board Segment 110 of Train TR holds proper authority. Furthermore, the placement of clearance points may also assist in connecting or providing authority limits for tracks associated with switches or turnouts.

It will be appreciated that the one or more targets may include, but are not limited to, switch targets, stop targets, signal targets, switch alignment and switch position unknown targets, movement authority targets, or any other targets that the On-Board Segment 110 may be programmed and/or configured to identify, place, and/or generate at appropriate locations in order to prevent collisions on tracks and/or fouling of rail equipment. These appropriate locations and/or situations to identify, place, and generate a target may include, but is not limited to, clearance points during a trailing approach of a switch by a train in order to protect against collision with fouling equipment and stop the train from advancing so close to the point of switch such that the switch cannot be thrown. Another appropriate location and/or situation to identify, place, and generate a target may include, but is not limited to a point of switch where the status of all switches and signals at a control point are unknown to an on-board segment of a train during a facing approach of a switch associated with a control point by the train. Still another appropriate location and or situation may include, but is not limited to, the locations of signals where the status of all switches and signals at the control point are unknown to an on-board segment of a train during a facing approach or trailing approach of a switch by the train.

In locations where the On-Board Segment 110 has identified, placed, and/or generated targets, the On-Board Segment 110 may be further programmed and/or configured to remove one or more targets and allow the train to advance beyond the target, when the On-Board Segment 110 of the train has received authority, including, but not limited to, PSS form-based authority or received permission to proceed from an operator's or engineer's input into an Input Device integrated or coupled to the Display Device 220 regarding the one or more targets.

Additionally, where a clearance point also marks a dispatchable point, a milepost helper may be placed coincident with the clearance point. The placement of a milepost helper will ensure that mileposts associated with authority limits provided by the Dispatch System 106 based on one data format that may be utilized by the Dispatch System 106 for issuing authority limits, corresponds to offsets in a different data format that may be utilized by the Management System 142 of Train TR. Additionally, the GIS and/or Office Segment 112 may also be programmed and/or configured to ensure that features identified in one data format, such as, for example, PTC Data Model format are at the identical offsets and in particular, at the same latitude, longitude, and elevation as those in a different data format, such as, for example, Subdivision Track Data format. Thus, in one non-limiting exemplary implementation, the GIS and/or Office Segment 112 may be programmed and/or configured to place track features in the Subdivision Track Data format at the same offsets as those identified in the PTC Data Model format via one or more conversion processes.

In some implementations, clearance points for a switch or turnout may be located in a different subdivision/district than the location of the switch or turnout. In one non-limiting exemplary implementation, a clearance point in the PTC Data Model format may be referenced to a node (e.g., a switch or turnout) with an associated node type: "Routing," if the switch or turnout is in the same subdivision/district as the clearance point; "Subdivision," if the switch or turnout is in a different subdivision/district, which is controlled by the same railroad operator as the subdivision/district containing the clearance point; or "Interconnect," if the switch or turnout is in a different subdivision/district, which is controlled by a different railroad operator than the subdivision/district containing the clearance point. In other non-limiting exemplary implementations, all clearance points in the PTC Data Model format may be referenced to nodes with an associated node type of "Routing," regardless of whether a clearance point is associated with a switch or turnout that is located in a different or the same subdivision/district or controlled by a different or the same railroad operator. With respect to the Subdivision Track Data format, the clearance point entries may contain at least a Subdivision/District ID and a SCAC field that identifies a railroad operator or transportation agent, which allows the On-Board Segment 110 to associate a clearance point with its switch or turnout even across subdivision/district and railroad boundaries. Regardless of what subdivision/district the clearance point is located in relation to the switch or turnout, the railroad operator may be assigned the responsibility to generate the Track Data and ensure that clearance points are identified for all switches on the track it controls as well as switches that adjoin its track.

Figure 3A:
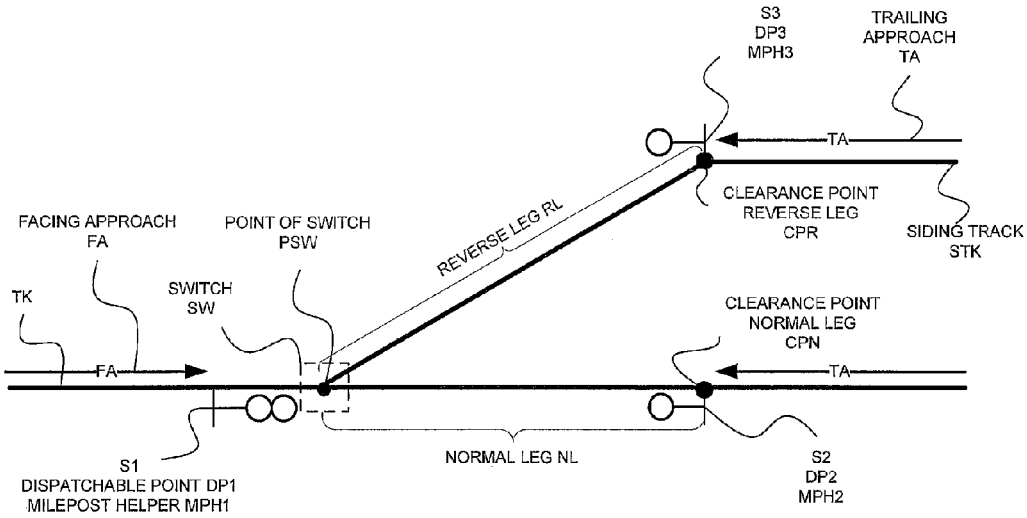
FIGS. 3(*a*)-(*b*) are schematic views of a non-limiting exemplary embodiment for clearance point placement in exemplary track and feature arrangements in the system and method of transforming movement authority limits according to the principles of the present invention.
Figure 3B:
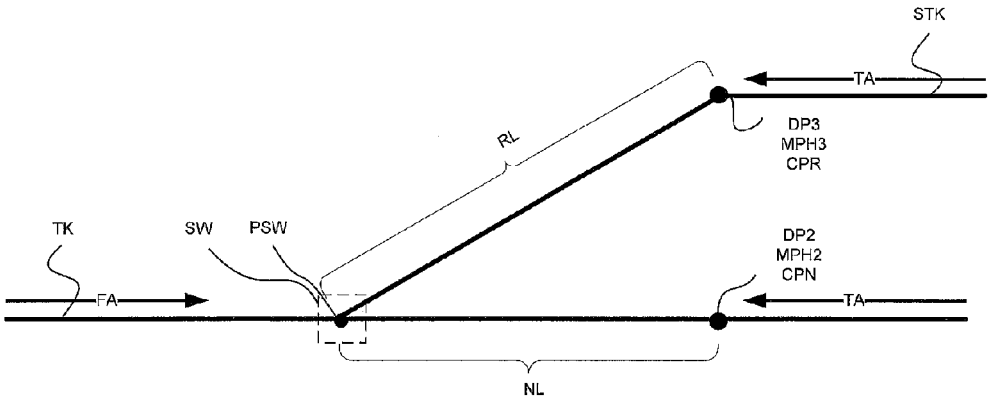

FIGS. 3(*a*)-(*b*) illustrate a non-limiting exemplary embodiment of clearance point identification, placement, and/or generation by a GIS and/or the Office Segment 112 for Track TK connected to a Siding Track STK by a Reverse Leg RL of Switch SW. Moreover, FIG. 3(*a*) illustrates the exemplary track and feature arrangement for a signaled, end of siding on a single main track, and FIG. 3(*b*) illustrates the exemplary track and feature arrangement for a non-signaled, end of siding on a single main track. In the non-limiting exemplary track and feature arrangement of FIG. 3(*a*), the Track TK, may include the Switch SW, a Point of Switch PSW, Signal S1, Signal S2, and a Normal Leg NL located between the Point of Switch PSW and the Signal S2. Siding Track STK may include Signal S3, such that a Reverse Leg RL of the Switch SW is located between the Point of Switch PSW and the Signal S3. Additionally, Dispatchable Point DP1, Dispatchable Point DP2, and Dispatchable Point DP3; and Milepost Helper MPH1, Milepost Helper MPH2, and Milepost Helper MPH3 may also be located coincident with the signal locations such as, for example, the locations of Signal S1, Signal S2, and Signal S3, respectively.

In the non-limiting exemplary embodiment of FIG. 3(*a*), the GIS and/or Office Segment 112 may be programmed and/or configured to place clearance points coincident with the signal locations. In particular, the GIS and/or Office Segment 112 may be programmed and/or configured to place Clearance Point Reverse Mark or Fix CPR and Clearance Point Normal Mark or Fix CPN in the Track Data coincident with the Signal S2 and Signal S3. This placement of Clearance Point Reverse Mark or Fix CPR may eliminate any gaps in authority, including gaps in form-based authority, when the On-board Segment 110 and/or the Office Segment 112 adds authority on the Reverse Leg RL of the Switch SW to connect authority segments on main tracks with siding tracks, such as, for example, Track TK with Siding Track STK. This placement of Clearance Point Reverse Mark or Fix CPR and Clearance Point Normal Mark or Fix CPN may also ensure that switch targets are generated by the On-Board Segment 110 at a point sufficient to provide fouling protection for a Trailing Approach TA by a railway vehicle traveling on Track TK or Siding Track STK. In one non-limiting exemplary embodiment, this sufficiency is determined at least partially based upon or in accordance with 49 C.F.R. §218.93 [*Title 49—Transportation; Subtitle B—Other Regulations Relating to Transportation; Chapter II—Federal Railroad Administration, Department of Transportation; Part* 218*—Railroad Operating Practices; Subpart F—Handling Equipment, Switches, and Fixed Derails*], where "clearance point" means "the location near a turnout beyond which it is unsafe for passage on an adjacent track(s). Where a person is permitted by a railroad's operating rules to ride the side of a car, a clearance point shall accommodate a person riding the side of a car." See http://definitions.uslegal.com/c/clearance-point-railroad-operating-practices/.

In the non-limiting exemplary track and feature arrangement of FIG. 3(*b*), Track TK, may include a Switch SW, a Point of Switch PSW, and a Normal Leg NL of the Switch SW located between the Point of Switch PSW and Dispatchable Point DP2. Dispatchable Point DP2 and Milepost Helper MPH2, and Dispatchable Point DP3 and Milepost Helper MPH3 may also be located on the Track TK and Siding Track STK, respectively. Additionally, the Reverse Leg RL of Switch SW may be located between Point of Switch PSW and Dispatchable Point DP3.

In the non-limiting exemplary embodiment of FIG. 3(*b*), the GIS and/or Office Segment 112 may be programmed and/or configured to place clearance points at a point sufficient to provide fouling protection for a Trailing Approach TA by a railway vehicle traveling on Track TK or Siding Track STK regardless of whether the clearance points are marked or unmarked in the field. Furthermore, if a device for fouling protection, such as, for example a derail device, is present, then the GIS and/or Office Segment 112 may be programmed and/or configured to place the clearance point at or near the fouling protection device. This placement of Clearance Point Reverse Mark or Fix CPR and Clearance Point Normal Mark or Fix CPN may ensure that the switch targets are generated at a point sufficient to provide fouling protection for a Trailing Approach TA by a railway vehicle traveling on Track TK or Siding Track STK. This placement may also eliminate any gaps in authority, including gaps in form-based authority when the On-Board Segment 110 and/or the Office Segment 112 adds Reverse Leg RL of the Switch SW to either: connect authority segments between Track TK and Siding Track STK, when the Siding Track STK is part of a controlled siding that requires authority from a dispatch system such as, for example, Dispatch System 106 before their occupancy by a railway vehicle; or provide authority to the end of controlled track when the Siding Track STK is part of an uncontrolled siding or tracks that do not require authority from a dispatch system before their occupancy by a railway vehicle. Exemplary uncontrolled tracks may include, but are not limited to, industrial spurs and/or tracks not under the control of the railroad operator but are under the control of a private entity which do not require form-based authority or signal authority in the railway vehicle's direction of movement. Additionally, it will be appreciated that in cases where signal authority is not required in the railway vehicle's direction of movement, signals, such as, for example Signal S1, Signal S2, and Signal S3 illustrated in FIG. 3(*a*) and elsewhere, may not exist in the field and in the Track Data or may be ignored by the railway vehicle in its direction of movement.

Figure 4A:
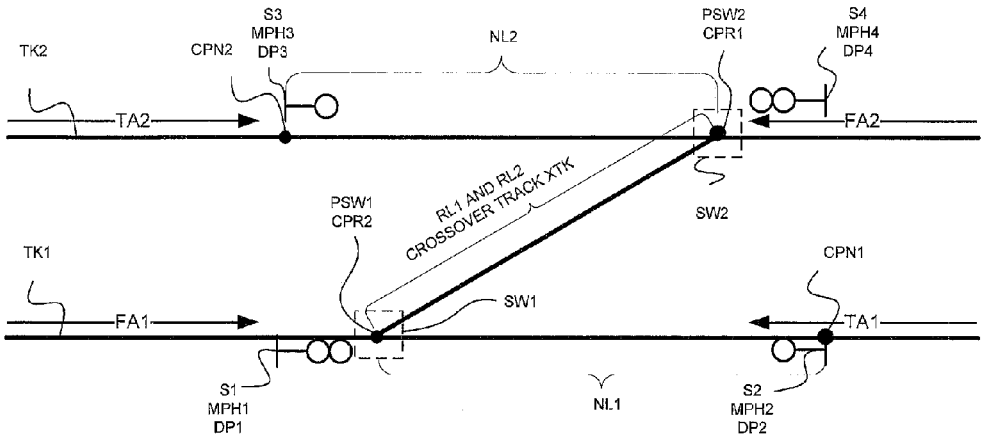
FIGS. 4(*a*)-(*b*) are schematic views of another non-limiting exemplary embodiment for clearance point placement in another set of exemplary track and feature arrangements in the system and method of transforming movement authority limits according to the principles of the present invention.
Figure 4B:
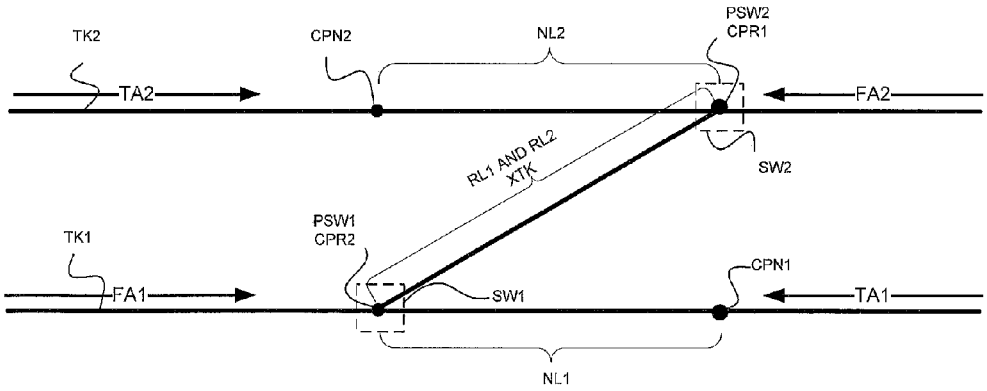

FIG. 4(*a*)-(*b*) illustrate a non-limiting exemplary embodiment of clearance point identification, placement, and/or generation by the GIS and/or Office Segment 112 for Track TK1 and Track TK2. FIG. 4(*a*) illustrates an exemplary track and feature arrangement for a signaled, single crossover on a double main track, and FIG. 4(*b*) illustrates a non-signaled, single crossover on a double main track. In the non-limiting exemplary track and feature arrangement of FIG. 4(*a*), the Track TK1, may include a Switch SW1, a Point of Switch PSW1 of Switch SW1, Signal S1, Signal S2, and a Normal Leg NL1 of Switch SW1 located between the Point of Switch PSW1 and the Signal S2. The Track TK2, may include a Switch SW2, a Point of Switch PSW2, Signal S3, Signal S4, and a Normal Leg NL2 of Switch SW2 located between the Signal S3 and the Point of Switch PSW2. The Track TK1 and Track TK2 may be connected via the Crossover Track XTK or the Reverse Leg RL1 and Reverse Leg RL2 of Switch SW1 and Switch SW2, respectively. Additionally, Dispatchable Point DP1, Dispatchable Point DP2, Dispatchable Point DP3, and Dispatchable Point DP4; and Milepost Helper MPH1, Milepost Helper MPH2, Milepost Helper MPH3, and Milepost Helper MPH4 may also be located coincident with the signal locations such as, for example, Signal S1, Signal S2, Signal S3, and Signal S4, respectively.

In a non-limiting exemplary embodiment of FIG. 4(*a*), the GIS and/or Office Segment 112 may be programmed and/or configured to place clearance points on the reverse leg of each switch at switch points of the opposing switch. Accordingly, the GIS and/or Office Segment 112 may be programmed and/or configured to place Clearance Point Reverse Mark or Fix CPR1 of Switch SW1 at or near Point of Switch PSW2 on Track TK2 and Clearance Point Reverse Mark or Fix CPR2 of Switch SW2 at or near Point of Switch PSW1 on Track TK1. This placement may eliminate any gaps in authority, including gaps in form-based authority, when the On-Board Segment 110 and/or the Office Segment 112 adds the Reverse Leg RL1 and Reverse Leg RL2 or the Crossover Track XTK to the Authority Data and/or Train Authority Data in order to provide authority for a train to travel between main tracks. This placement of clearance points also provides separation between switch and signal targets for example, when the status of an entire control point is unknown.

Continuing with the non-limiting exemplary embodiment of FIG. 4(*a*), the GIS and/or Office Segment 112 may be programmed and/or configured to place clearance points on the normal leg of each switch coincident with the signal locations. Accordingly, the GIS and/or Office Segment 112 may be programmed and/or configured to place Clearance Point Normal Mark or Fix CPN1 of Switch SW1 at or near Signal S2 on Track TK1 and Clearance Point Normal Mark or Fix CPN2 of Switch SW2 at or near Signal S3 on Track TK2. This placement of clearance points may ensure that switch targets are generated at a point sufficient to provide fouling protection for a Trailing Approach TA1 by railway vehicles traveling on Track TK1 or Trailing Approach TA2 by railway vehicles traveling on Track TK2.

In a non-limiting exemplary of track and feature arrangement of FIG. 4(*b*), the Track TK1 may include a Switch SW1, a Point of Switch PSW1, a Normal Leg NL1 of Switch SW1. The Track TK2, may include a Switch SW2, a Point of Switch PSW2, a Normal Leg NL2 of Switch SW2. The Track TK1 and Track TK2 may be connected via a Crossover Track XTK or Reverse Leg RL1 and Reverse Leg RL2 of Switch SW1 and Switch SW2, respectively.

In the non-limiting exemplary embodiment of FIG. 4(*b*), the GIS and/or Office Segment 112 may be programmed and/or configured to place clearance points on reverse leg of each switch at switch points of the opposing switch. Accordingly, the GIS and/or Office Segment 112 may be programmed and/or configured to place Clearance Point Reverse Mark or Fix CPR1 of Switch SW1 at or near Point of Switch PSW2 on Track TK2 and Clearance Point Reverse Mark or Fix CPR2 of Switch SW2 at or near Point of Switch PSW1 on Track TK1. This placement may eliminate any gaps in authority, including gaps in form-based authority, when the On-Board Segment 110 and/or the Office Segment 112 adds crossover tracks or the reverse switch legs to provide authority between main tracks.

Continuing with the non-limiting exemplary embodiment of FIG. 4(*b*), the GIS and/or Office Segment 112 may be further programmed and/or configured to place Clearance Point Normal Mark or Fix CPN1 on Track TK1 with a sufficient distance before the Point of Switch PSW1 for a Trailing Approach TA1 of Switch SW1 by a railway vehicle traveling on Track TK1, such that at least a portion of the Normal Leg NL1 is located between the Clearance Point Normal Mark or Fix CPN1 and the Point of Switch PSW1. Similarly, the GIS and/or Office Segment 112 may be further programmed and/or configured to place Clearance Point Normal Mark or Fix CPN2 on Track TK2 with a sufficient distance before the Point of Switch PSW2 for a Trailing Approach TA2 of Switch SW2 by a railway vehicle traveling on Track TK2. This placement of clearance points may ensure that clearance points on the normal leg of each switch are placed at a point sufficient to provide fouling protection for a Trailing Approach TA1 by railway vehicles traveling on Track TK1 or Trailing Approach TA2 by railway vehicles traveling on Track TK2.

Figure 5:
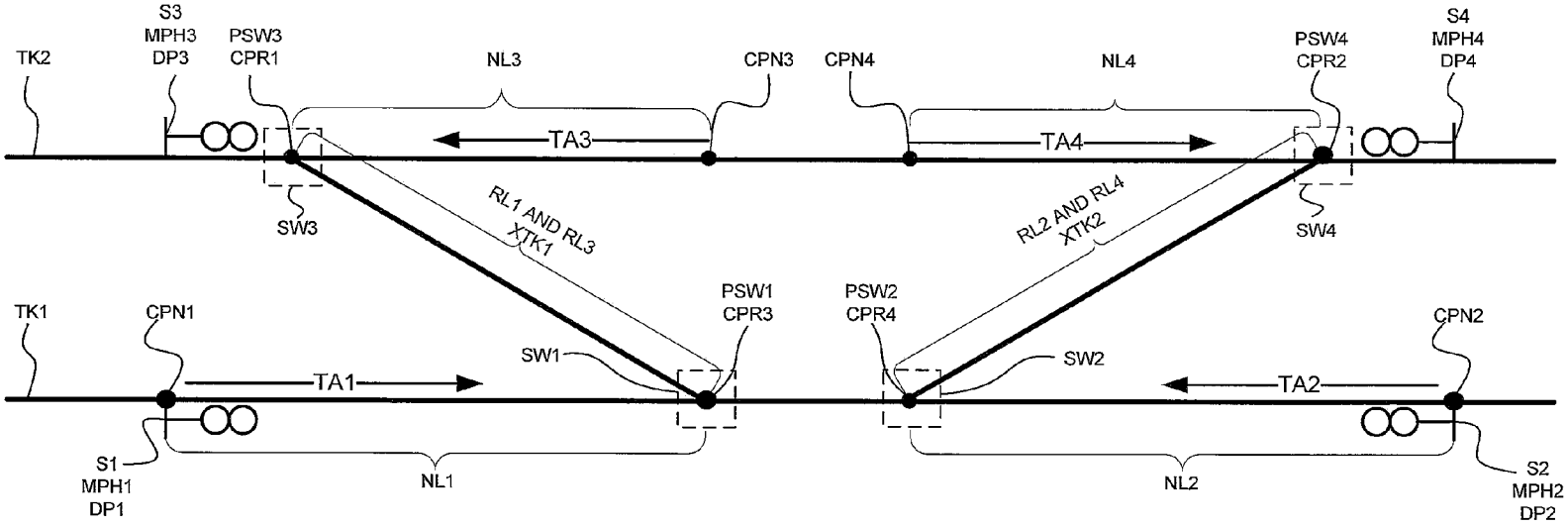
FIG. 5 is a schematic view of still another non-limiting exemplary embodiment of clearance point placement in another exemplary track and feature arrangement in the system and method of transforming movement authority limits according to the principles of the present invention.

FIG. 5 illustrates a non-limiting exemplary embodiment of clearance point identification, placement, and/or generation by the GIS and/or Office Segment 112 for Track TK1 and Track TK2. Moreover, FIG. 5 illustrates an exemplary track and feature arrangement for a signaled, double crossover on a double main track. In the non-limiting exemplary track and feature arrangement of FIG. 5, the Track TK1, may include a Signal S1, Switch SW1, a Point of Switch PSW1 of Switch SW1, and a Normal Leg NL1 of Switch SW1 located between the Signal S1 and the Point of Switch PSW1. In addition, the Track TK1 may further include, a Switch SW2, a Point of Switch PSW2 of Switch SW2, Signal S2, and a Normal Leg NL2 of Switch SW2. Track TK2, may include a Signal S3, a Switch SW3, a Point of Switch PSW3, a Switch SW4, a Point of Switch SW4, a Signal S4, Normal Leg NL3, and Normal leg NL4.

The Track TK1 and Track TK2 may be connected via the Crossover Track XTK1 (i.e., Reverse Leg RL1 and Reverse Leg RL3 of Switch SW1 and Switch SW3, respectively). The Track TK1 and Track TK2 may be further connected via the Crossover Track XTK2 (i.e., Reverse Leg RL2 and Reverse Leg RL4 of Switch SW2 and Switch SW4, respectively). Additionally, Dispatchable Points DP1, Dispatchable Point DP2, Dispatchable Point DP3, and Dispatchable Point DP4; and Milepost Helper MPH1, Milepost Helper MPH2, Milepost Helper MPH3, and Milepost Helper MPH4 may also be located coincident with the signal locations such as, for example, Signal S1, Signal S2, Signal S3, and Signal S4, respectively.

In the non-limiting exemplary embodiment of FIG. 5, the GIS and/or Office Segment 112 may be programmed and/or configured to place clearance points on the reverse leg of each switch at switch points of the opposing switch. Accordingly, the GIS/ and/or Office Segment 112 may be programmed and/or configured to place Clearance Point Reverse Mark or Fix CPR1 of Switch SW1 at or near Point of Switch PSW3 and Clearance Point Reverse Mark or Fix CPR2 of Switch SW2 at or near Point of Switch PSW4 on Track TK2. The GIS and/or Office Segment 112 may be further programmed and/or configured to place Clearance Point Reverse Mark or Fix CPR3 of Switch SW3 at or near Point of Switch PSW1 and Clearance Point Reverse Mark or Fix CPR4 of Switch SW4 at or near Point of Switch PSW2 on Track TK1. This placement may eliminate any gaps in authority, including gaps in form-based authority, when the On-Board Segment 110 and/or the Office Segment 112 adds Crossover Track XTK1 (i.e., Reverse Leg RL1 or Reverse Leg RL3) and/or Crossover Track XTK2 (i.e., Reverse Leg RL2 or Reverse Leg RL4) to the Authority Data and/or Train Authority Data in order to provide authority for a train to travel between the double main tracks. This placement of clearance points also provides separation between switch and signal targets for cases when the status of an entire control point is unknown.

In the non-limiting exemplary embodiment of FIG. 5, the GIS and/or Office Segment 112 may be programmed and/or configured to place clearance points on the normal legs of switches on Track TK1 coincident with the signal locations on Track TK1. Accordingly, the GIS and/or Office Segment 112 may be programmed and/or configured to place Clearance Point Normal Mark or Fix CPN1 of Switch SW1 at or near Signal S1 and Clearance Point Normal Mark or Fix CPN2 of Switch SW2 at or near Signal S2 on Track TK1. This placement of clearance points may ensure that switch targets are generated at a point sufficient to provide fouling protection for a Trailing Approach TA1 of Switch SW1 by railway vehicles traveling on Track TK1 or Trailing Approach TA2 of Switch SW2 by railway vehicles traveling on Track TK1.

Continuing with the non-limiting exemplary embodiment of FIG. 5, the GIS and/or Office Segment 112 may be further programmed and/or configured to place Clearance Point Normal Mark or Fix CPN3 on Track TK2 with a sufficient distance before the Point of Switch PSW3 for a Trailing Approach TA3 of Switch SW3 by a railway vehicle traveling on Track TK2, such that at least a portion of the Normal Leg NL3 is located between Point of Switch PSW3 and Clearance Point Normal Mark or Fix CPN3. Similarly, the GIS and/or Office Segment 112 may be further programmed and/or configured to place Clearance Point Normal Mark or Fix CPN4 on Track TK2 with a sufficient distance before the Point of Switch PSW4 for a Trailing Approach TA4 of Switch SW4 by a railway vehicle traveling on Track TK2, such that at least a portion of the Normal leg NL4 is located between Clearance Point Normal Mark or Fix CPN4 and Point of Switch PSW4. This placement of clearance points may ensure that clearance points on the normal leg of each switch on Track TK2 are placed at a point sufficient to provide fouling protection for a Trailing Approach TA3 or Trailing Approach TA4 by railway vehicles traveling on Track TK2.

Figure 6:
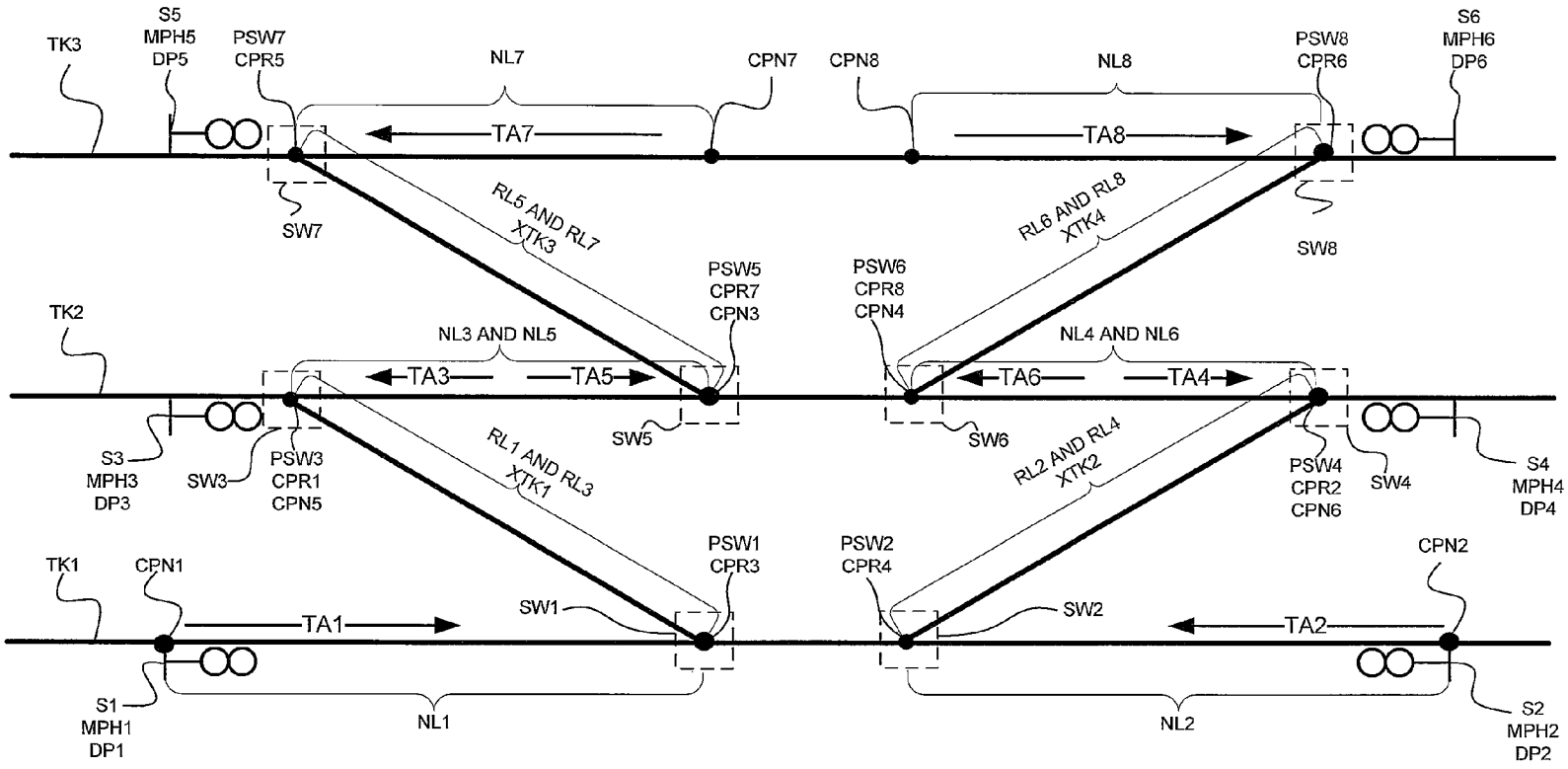
FIG. 6 is a schematic view of yet another non-limiting exemplary embodiment of clearance point placement in another exemplary track and feature arrangement in the system and method of transforming movement authority limits according to the principles of the present invention.

FIG. 6 illustrates another non-limiting exemplary embodiment of clearance point identification, placement, and/or generation by the GIS and/or Office Segment 112 for Track TK1, Track TK2, and Track TK3. Moreover, FIG. 6 illustrates an exemplary track and feature arrangement of a signaled, double crossovers on a triple main track. The placement of clearance points in the non-limiting exemplary track and feature arrangement of FIG. 6, is similar to placement of clearance points with respect to non-limiting exemplary embodiments of FIGS. 4(*a*)-(*b*) and FIG. 5. Thus, the GIS and/or Office Segment 112 may be programmed and/or configured to place clearance points on the normal legs of switches on Track TK1 coincident with the signal locations on Track TK1. In particular, the GIS and/or Office Segment 112 may be programmed and/or configured to place Clearance Point Normal Mark or Fix CPN1 of Switch SW1 at or near Signal S1 and Clearance Point Normal Mark or Fix CPN2 of Switch SW2 at or near Signal S2 on Track TK1. This placement of clearance points may ensure that switch targets are generated at a point sufficient to provide fouling protection for a Trailing Approach TA1 of Switch SW1 by railway vehicles traveling on Track TK1 or Trailing Approach TA2 of Switch SW2 by railway vehicles traveling on Track TK1.

In the non-limiting exemplary embodiment of FIG. 6, the GIS and/or Office Segment 112 may be further programmed and/or configured to place Clearance Point Normal Mark or Fix CPN3, Clearance Point Normal Mark or Fix CPN4, Clearance Point Normal Mark or Fix CPN5, and Clearance Point Normal Mark or Fix CPN6 on Track TK2 with a sufficient distance before Point of Switch PSW3 for a Trailing Approach TA3, Point of Switch PSW4 for a Trailing Approach TA4, Point of Switch PSW5 for a Trailing Approach TA5, and Point of Switch PSW6 for a Trailing Approach TA6 on Track TK2, respectively. Thus, the GIS and/or Office Segment 112 may be further programmed and/or configured to place Clearance Point Normal Mark or Fix CPN3, Clearance Point Normal Mark or Fix CPN4, Clearance Point Normal Mark or Fix CPN5, Clearance Point Normal Mark or Fix CPN6 at or near Point of Switch PSW5, Point of Switch PSW6, Point of Switch PSW3, and Point of Switch PSW4 on Track TK2, respectively. This placement of clearance points may ensure that clearance points on the normal legs of switches on Track TK2 are placed at a point sufficient to provide fouling protection for a Trailing Approach TA3 of the Point of Switch PSW3, Trailing Approach TA4 of the Point of Switch PSW4, Trailing Approach TA5 of the Point of Switch PSW5, and Trailing Approach TA6 of the Point of Switch PSW6 on Track TK2 by railway vehicles traveling on Track TK2.

Continuing with the non-limiting exemplary embodiment of FIG. 6, the GIS and/or Office Segment 112 may be further programmed and/or configured to place Clearance Point Normal Mark or Fix CPN7 and Clearance Point Normal Mark or Fix CPN8 on Track TK3 with a sufficient distance before Point of Switch PSW7 for a Trailing Approach TA7 and Point of Switch PSW8 for a Trailing Approach TA8 on Track TK3, respectively. This placement of clearance points may ensure that clearance points on the normal legs of switches on Track TK3 are placed at a point sufficient to provide fouling protection for a Trailing Approach TA7 of the Point of Switch PSW7 and Trailing Approach TA8 of the Point of Switch PSW8 on Track TK3 by railway vehicles traveling on Track TK3.

With continued reference to the non-limiting exemplary embodiment of FIG. 6, the GIS and/or Office Segment 112 may be programmed and/or configured to place clearance points on the reverse leg of each switch at switch points of the opposing switch similar to the placement of Clearance Point Reverse Mark or Fix CPR1, Clearance Point Reverse Mark or Fix CPR2, Clearance Point Reverse Mark or Fix CPR3, and Clearance Point Reverse Mark or Fix CPR4 as illustrated with respect to non-limiting exemplary embodiment of FIG. 5. Additionally, the GIS and/or Office Segment 112 may be programmed and/or configured to place Clearance Point Reverse Mark or Fix CPR7 of Switch SW7 at or near Point of Switch PSW5 and Clearance Point Reverse Mark or Fix CPR8 of Switch SW8 at or near Point of Switch PSW6 on Track TK2. Further, the GIS and/or Office Segment 112 may be further programmed and/or configured to place Clearance Point Reverse Mark or Fix CPR5 of Switch SW5 at or near Point of Switch PSW7 and Clearance Point Reverse Mark or Fix CPR6 of Switch SW6 at or near Point of Switch PSW8 on Track TK3. This placement may eliminate any gaps in authority, including gaps in form-based authority, when the On-Board Segment 110 and/or the Office Segment 112 adds Crossover Track XTK1, Crossover Track XTK2, Crossover Track XTK3, and/or Crossover Track XTK4 to the Authority Data and/or Train Authority Data in order to provide authority for a train to travel between the triple main tracks. This placement of clearance points and in particular, Clearance Point Reverse Mark or Fix CPR1, Clearance Point Reverse Mark or Fix CPR2, Clearance Point Reverse Mark or Fix CPR5, Clearance Point Reverse Mark or Fix CPR6 also provides separation between switch and signal targets, such as, for example, when the status of an entire control point is unknown.

Figure 7:
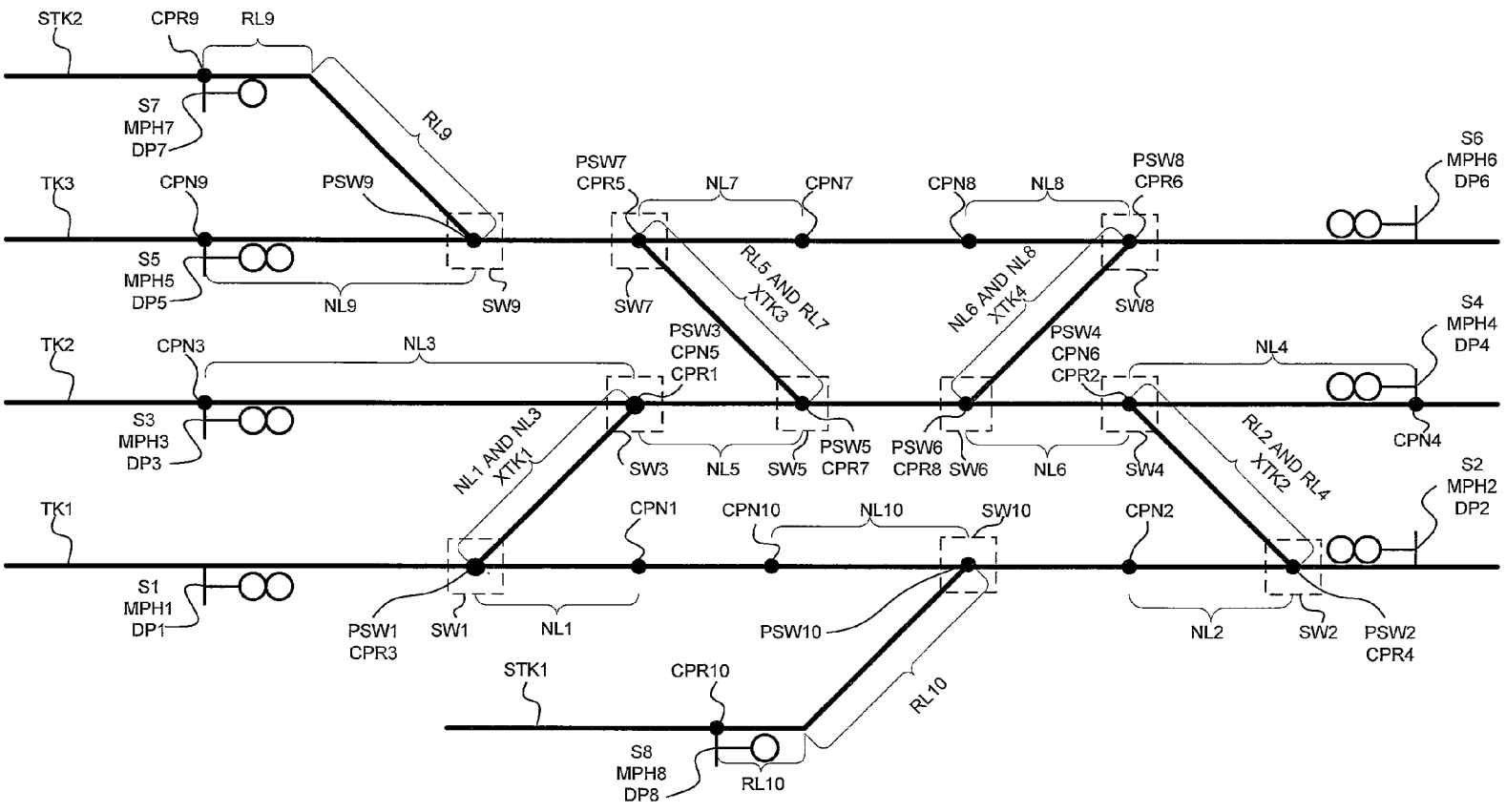
FIG. 7 is a schematic view of still another non-limiting exemplary embodiment of clearance point placement in another exemplary track and feature arrangement in the system and method of transforming movement authority limits according to the principles of the present invention.

FIG. 7 illustrates a non-limiting exemplary embodiment of clearance point identification, placement, and/or generation by the GIS and/or Office Segment 112 for Track TK1, Track TK2, Track TK3, Siding Track STK1, and Siding Track STK2. Moreover, FIG. 7 illustrates an exemplary track and feature arrangement of a signaled, double crossovers on triple main track including signaled, endings of sidings on main tracks Track TK1 and Track TK3. The placement of clearance points in the non-limiting exemplary track and feature arrangement of FIG. 7, is similar to placement of clearance points with respect to non-limiting exemplary embodiments of FIGS. 3(*a*)-(*b*), and FIGS. 4(*a*)-(*b*). Thus, the GIS and/or Office Segment 112 may be programmed and/or configured to place clearance point normal legs associated with switches connected to crossover tracks at a point sufficient to provide fouling protection for trailing approaches of their respective point of switch. In some cases, the GIS and/or Office Segment 112 may be programmed and/or configured to place clearance point normal legs associated with switches connected to crossover tracks coincident with signal locations such as, Signal S3 and Signal S4 as illustrated in FIG. 7.

In the non-limiting exemplary embodiment of FIG. 7, the GIS and/or Office Segment 112 may be further programmed and/or configured to place clearance point reverse legs at or near point of switches to eliminate any gaps in authority, including gaps in form-based authority, when the On-Board Segment 110 and/or the Office Segment 112 adds Crossover Track XTK1, Crossover Track XTK2, Crossover Track XTK3, and/or Crossover Track XTK4 to the Authority Data and/or Train Authority Data in order to provide authority for a train to travel between the triple main tracks Track TK1, Track TK2, and Track TK3. Further, with respect to clearance point reverse legs and clearance point normal legs associated with switches connecting siding tracks, GIS and/or Office Segment 112 may be programmed and/or configured to place these clearance points coincident with the signal locations such as, for example, Signal S7, Signal S5, and Signal S8 as illustrated in FIG. 7. This placement of clearance point reverse legs may eliminate any gaps in authority, including gaps in form-based authority, when the On-Board Segment 110 and/or the Office Segment 112 adds reverse legs to the Authority Data and/or Train Authority Data in order to provide authority for a train to travel between the siding tracks and main tracks. This placement of clearance point reverse legs and clearance point normal legs may also ensure that switch targets are generated at a point sufficient to provide fouling protection for trailing approaches of their respective point of switch.

In addition to clearance point placements illustrated in non-limiting exemplary embodiments of FIGS. 3(*a*)-(*b*), FIGS. 4(*a*)-(*b*), FIG. 5, FIG. 6, and FIG. 7, the GIS and/or Office Segment 112 may be further programmed and/or configured to ensure that a clearance point is placed at the same offset as a change in method of operation when the method of operation changes from track where form-based authority is required to track where form-based authority is not required. This may avoid any gaps in authority where the railway vehicle may need authority to travel on but cannot receive authority. The GIS and/or Office Segment 112 may also be programmed and/or configured to add a milepost helper at the location of the change in method of operation, if a milepost helper does not already exist at the end of a track segment to ensure that authority limits, such as, for example, from-and-to mileposts on one or more tracks issued by a dispatch system lines up with the end of track where form-based authority is required.

Figure 8A:
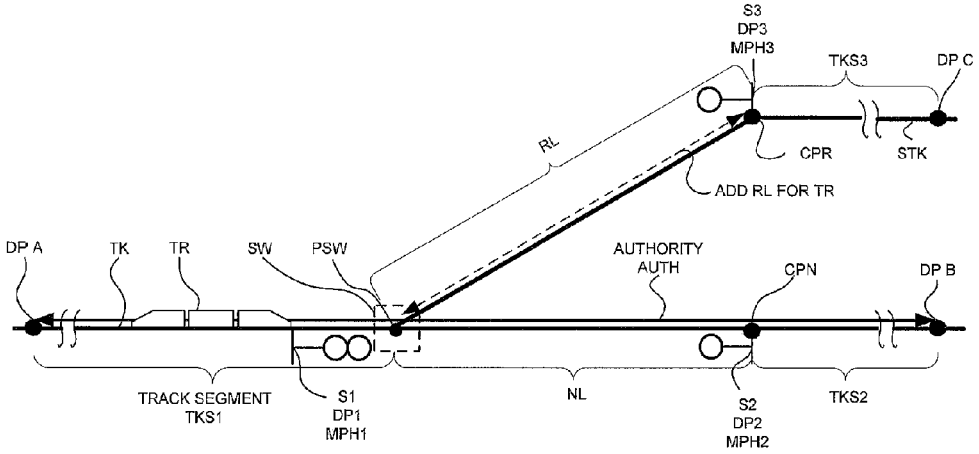
FIGS. 8(*a*)-(*b*) are schematic views of a non-limiting exemplary embodiment for providing authority to a switch leg of another exemplary track and feature arrangement in the system and method of transforming movement authority according to the principles of the present invention.
Figure 8B:
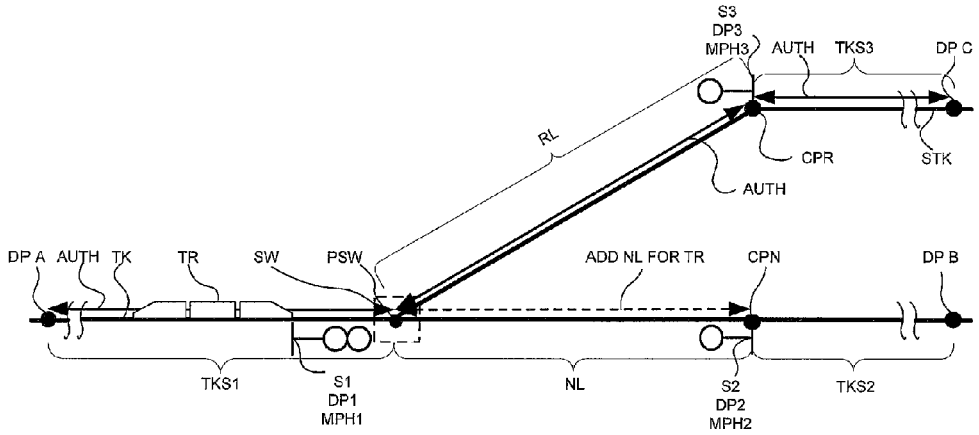
Figure 10A:
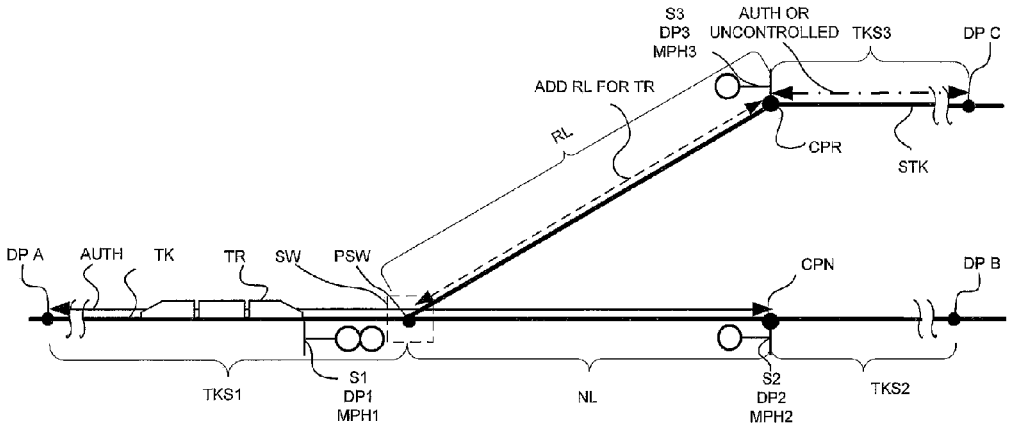
FIGS. 10(*a*)-(*b*) are schematic views of yet another non-limiting exemplary embodiment for providing authority to a switch leg in another exemplary track and feature arrangement in the system and method of transforming movement authority according to the principles of the present invention.
Figure 10B:
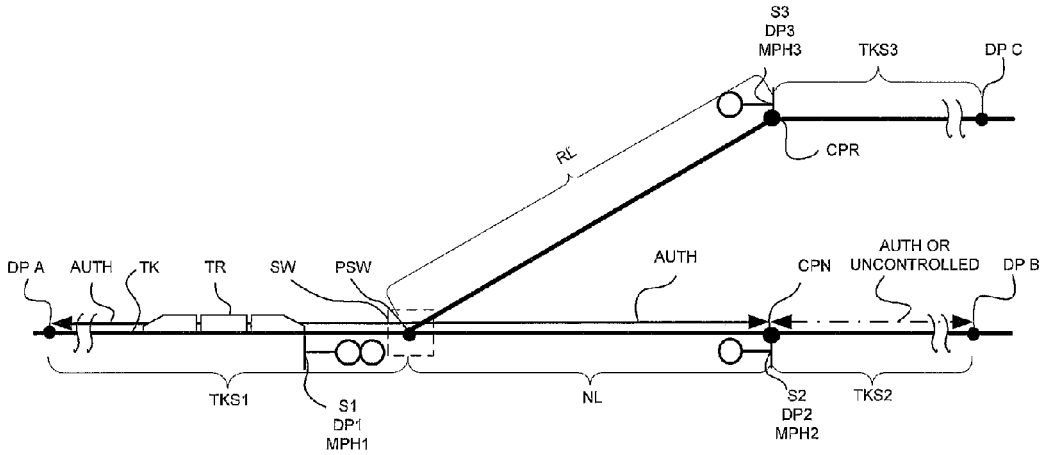

FIGS. 8(*a*)-(*b*) and FIGS. 10(*a*)-(*b*) illustrate non-limiting embodiments of adding switch legs for a particular track and feature arrangement. In the non-limiting exemplary track and feature arrangement of FIGS. 8(*a*)-(*b*) and FIGS. 10(*a*)-(*b*), Train TR is traveling on Track TK, which may include a Switch SW, a Point of Switch PSW, Signal S1, Signal S2, and a Normal Leg NL located between the Point of Switch PSW and the Signal S2. The Siding Track STK may include Signal S3, such that a Reverse Leg RL of the Switch SW is located between the Point of Switch PSW and the Signal S3. Additionally, Dispatchable Point DP1, Dispatchable Point DP2, and Dispatchable Point DP3; and Milepost Helper MPH1, Milepost Helper MPH2, Milepost Helper MPH3 may also be located coincident with the signal locations such as, for example, the locations of Signal S1, Signal S2, and Signal S3, respectively. In addition, extending to the left and right of the Track TK may include Dispatchable Point DP A and Dispatchable Point DP B, respectively. Extending to the right of Siding Track STK may include Dispatchable Point DP C. In accordance with previously discussed clearance point placement in the Track Data, Clearance Point Normal Mark or Fix CPN and Clearance Point Reverse Mark or Fix CPR may be located coincident with Signal S2 and Signal S3, respectively. The Switch SW may be associated with Track Segment TKS1 on the facing side of Switch SW, and associated with Track Segment TKS2 and Track Segment TKS3 to the right of the Normal Leg NL and Reverse Leg RL, respectively, of Switch SW.

In the non-limiting exemplary embodiment of FIG. 8(*a*)-(*b*), the Office Segment 112 and/or the On-Board Segment 110 may be programmed and/or configured to add a switch leg of a switch to the authority limits of a railway vehicle, if the authority limits for the railway vehicle includes track on the facing side of the switch and one switch leg of the switch, then the other switch leg of the switch from the point of switch to the clearance point may be added to the railway vehicle's authority limits. In particular, the Office Segment 112 and/or the On-Board Segment 110 of Train TR may be programmed and/or configured to determine based on Authority Data and/or Train Authority Data whether authority limits for Train TR includes at least a portion of Track Segment TKS1, at least a portion of the Reverse Leg RL, and at least a portion of the Normal Leg NL. If authority limits for Train TR includes at least a portion of Track Segment TKS1 and at least a portion of the Normal Leg NL, then the Office Segment 112 and/or the On-Board Segment 110 may be programmed and/or configured to add the Reverse Leg RL to the Authority Data and/or the Train Authority Data for Train TR. Alternatively, if authority limits for Train TR includes at least a portion of Track Segment TKS1 and at least a portion of the Reverse Leg RL, then the Office Segment 112 and/or the On-Board Segment 110 may be programmed and/or configured to add the Normal Leg NL to the Authority Data and/or Train Authority Data for Train TR.

With respect to the operation of Train TR in the non-limiting exemplary embodiment of FIG. 8(*a*), Dispatch System 106 may provide Authority Data to the Office Segment 112 (e.g., Back Office System 108) and/or the On-Board Segment 110 of Train TR for the Train TR to travel on Track TK between Dispatchable Point DP A and Dispatchable Point DP B. The Office Segment 112 and/or the On-Board Segment 110 may be programmed and/or configured to add Reverse Leg RL to the Authority Data and/or Train Authority Data for Train TR (i.e., ADD RL FOR TR), because the authority limits contained in the Authority Data and/or the Train Authority Data for Train TR includes Authority AUTH for at least a portion of Track Segment TKS1 and Normal Leg NL. It will be appreciated that while authority limits for Train TR may include Authority AUTH for at least a portion of Track Segment TKS2, the Office Segment 112 and/or the On-Board Segment 110 may be programmed and/or configured to add Reverse Leg RL to the Authority Data and/or Train Authority Data regardless of whether authority limits for Train TR includes Authority AUTH for Track Segment TKS2.

With respect to the operation of Train TR in the non-limiting exemplary embodiment of FIG. 8(*b*), the Dispatch System 106 may provide Authority Data to the Office Segment 112 (e.g., Back Office System 108) and/or the On-Board Segment 110 of Train TR for the Train TR to travel on Track TK between Dispatchable Point DP A and Dispatchable Point DP C including Reverse Leg RL but not including Normal Leg NL or Track Segment TKS2. The Office Segment 112 and/or the On-Board Segment 110 may be programmed and/or configured to add Normal Leg NL to the Authority Data and/or Train Authority Data for Train TR (i.e., ADD NL FOR TR), because the authority limits contained in the Authority Data and/or Train Authority Data for Train TR includes Authority for at least a portion of Track Segment TKS1 and for at least a portion of Normal Leg NL. It will be appreciated that while authority limits for Train TR may include at least a portion of Track Segment TKS3, the Office Segment 112 and/or the On-Board Segment 110 may be programmed and/or configured to add Normal Leg NL to the Authority Data and/or Train Authority Data regardless of whether authority limits for Train TR includes Track Segment TKS3.

Figure 9A:
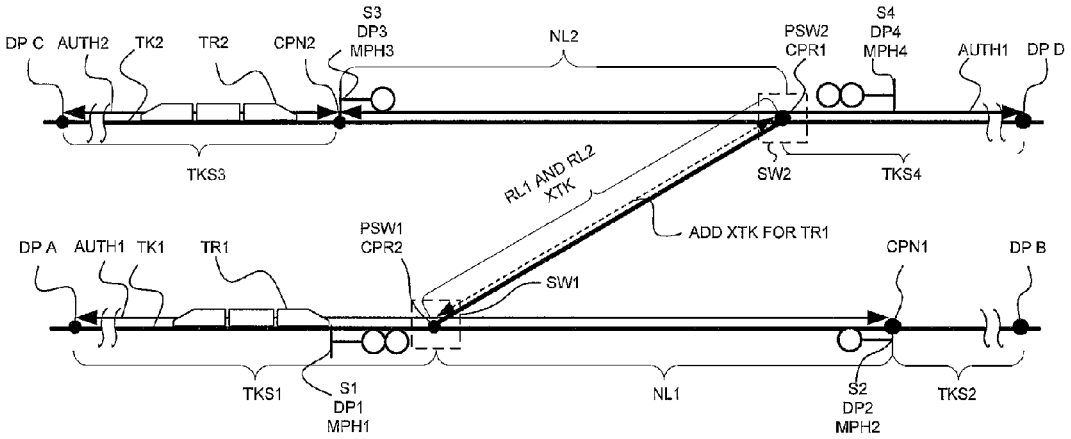
FIGS. 9(*a*)-(*b*) are schematic views of another non-limiting exemplary embodiment for providing authority to a crossover track in another exemplary track and feature arrangement in the system and method of transforming movement authority according to the principles of the present invention.
Figure 9B:
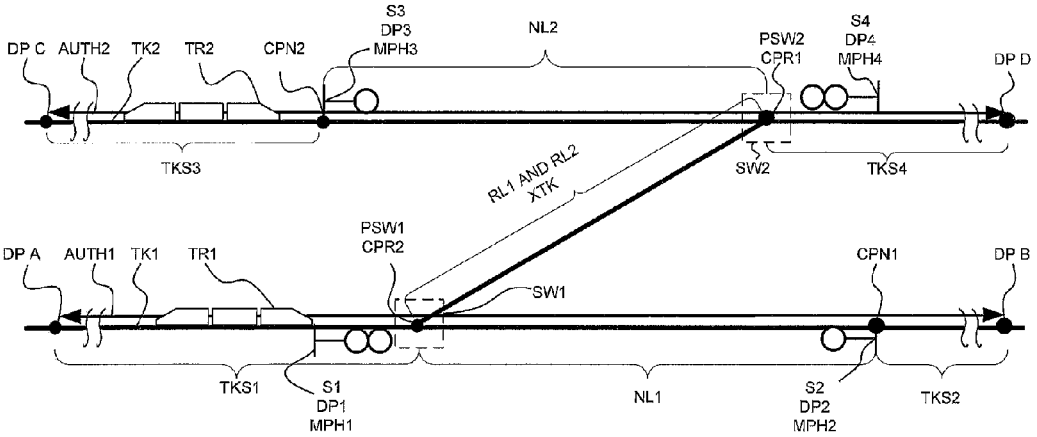
Figure 11A:
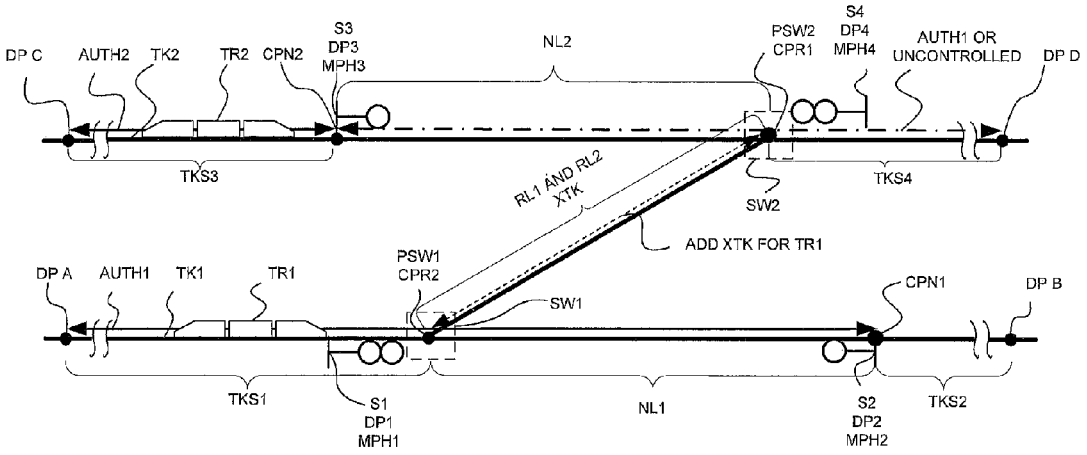
FIGS. 11(*a*)-(*b*) are schematic views of still another non-limiting exemplary embodiment for providing authority to a crossover track in another exemplary track and feature arrangement in the system and method of transforming movement according to the principles of the present invention.
Figure 11B:
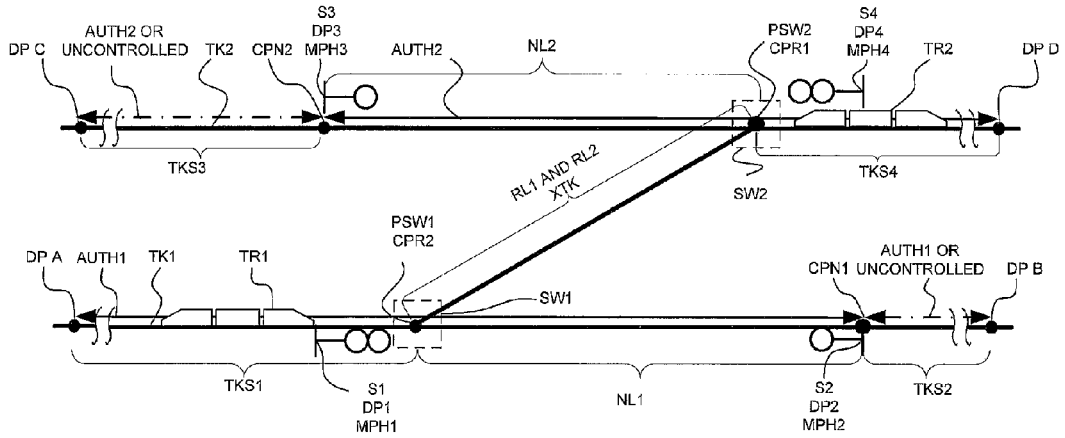

FIGS. 9(*a*)-(*b*) and FIGS. 11(*a*)-(*b*) illustrate non-limiting exemplary embodiments of adding switch legs and/or crossover tracks for another track and feature arrangement. In the non-limiting exemplary track and feature arrangement of FIGS. 9(*a*)-(*b*) and FIGS. 11(*a*)-(*b*), Train TR1 is traveling on Track TK1, which may include a Switch SW1, a Point of Switch PSW1, Signal S1, Signal S2, and a Normal Leg NL1 of the Switch SW1 located between the Point of Switch PSW1 and the Signal S2. Train TR2 is traveling on Track TK2 which may include Switch SW2, a Point of Switch PSW2, Signal S3, Signal S4, and a Normal leg NL2 of the Switch SW2 located between the Signal S3 and the Point of Switch PSW2. Additionally, Dispatchable Point DP1, Dispatchable Point DP2, Dispatchable Point DP3, Dispatchable Point DP4; and Milepost Helper MPH1, Milepost Helper MPH2, Milepost Helper MPH3, and Milepost Helper MPH4 may also be located coincident with the signal locations of Signal S1, Signal S2, Signal S3, and Signal S4, respectively. In addition, extending to the left and right of Track TK1 may include Dispatchable Point DP A, and Dispatchable Point DP B, respectively. Extending to the left and right of Track TK2 may include Dispatchable Point DP C and Dispatchable Point DP D, respectively.

With continued reference to the exemplary track and feature arrangements in FIGS. 9(*a*)-(*b*) and FIGS. 11(*a*)-(*b*) and in accordance with previously discussed clearance point identification and placement in the Track Data, Clearance Point Normal Mark or Fix CPN1 of Switch SW1 and Clearance Point Normal Mark or Fix CPN2 of Switch SW2 may be located coincident with the signal locations of Signal S2 and Signal S3, respectively. Clearance Point Reverse Mark or Fix CPR1 and Clearance Point Reverse Mark or Fix CPR2 may be located at or near Point of Switch PSW2 and Point of Switch PSW1, respectively. The Switch SW1 and Switch SW2 may further include Reverse Leg RL1 and Reverse Leg RL2 or Crossover Track XTK located between Track TK1 and Track TK2. The Switch SW1 may be associated with Track Segment TKS1 on the facing side of the Switch SW1 and associated with Track Segment TKS2 and Track Segment TKS4 extending to the right of Normal Leg NL1 and Reverse Leg RL1, respectively. The Switch SW2 may be associated with Track Segment TKS4 on the facing side of the Switch SW2, and associated with Track Segment TKS3 and Track Segment TKS1 extending to the left of Normal Leg NL2 and left of Reverse Leg RL2, respectively.

In the non-limiting exemplary embodiment of FIGS. 9(*a*)-(*b*), the Office Segment 112 and/or the On-Board Segment 110 may be programmed and/or configured to add the Crossover Track XTK (i.e., Reverse Leg RL1 or Reverse Leg RL2) to the authority limits of a railway vehicle, when authority limits contained in Authority Data and/or Train Authority Data includes authority for a railway vehicle on the facing side of a switch and in advance of the switch on one track, and in advance of the clearance point on the other track.

With respect to Train TR1 in the non-limiting exemplary embodiments of FIGS. 9(*a*)-(*b*), the Office Segment 112 and/or the On-Board Segment 110 of Train TR1 may be programmed and/or configured to determine, based on Authority Data and/or Train Authority Data, whether authority limits for Train TR1 includes authority for at least a portion of Track Segment TKS1, at least a portion of Normal Leg NL1, and at least a portion of Track Segment TKS4. Moreover, if authority limits for Train TR1 includes Authority AUTH1 on at least a portion of Track Segment TKS1, at least a portion of the Normal Leg NL1, and at least a portion of Track Segment TKS4, then the Office Segment 112 and/or the On-Board Segment 110 of Train TR1 may be programmed and/or configured to add the Crossover Track XTK (i.e., Reverse Leg RL1 or Reverse Leg RL2) to the Authority Data and/or Train Authority Data for Train TR1.

With respect to Train TR2 in the non-limiting exemplary embodiments of FIGS. 9(*a*)-(*b*), the Office Segment 112 and/or the On-Board Segment 110 of Train TR2 may be programmed and/or configured to determine, based on Authority Data and/or Train Authority Data, whether authority limits for Train TR2 includes authority for at least a portion of Track Segment TKS4, at least a portion of Normal Leg NL2, and at least a portion of Track Segment TKS1. Thus, if authority limits for Train TR2 includes Authority AUTH2 on at least a portion of Track Segment TKS4, at least a portion of the Normal Leg NL2, and at least a portion of the Track Segment TKS1, then the Office Segment 112 and/or the On-Board Segment 110 of Train TR2 may be programmed and/or configured to add the Crossover Track XTK (i.e., Reverse Leg RL1 or Reverse Leg RL2) to the Authority Data and/or Train Authority Data for Train TR2.

With respect to the operation of Train TR1 in the non-limiting embodiment of FIG. 9(*a*), the Dispatch System 106 may provide Authority Data to the Office Segment 112 (e.g., Back Office System 108) and/or the On-Board Segment 110 of Train TR1 for the Train TR1 to travel on Track TK1 between Dispatchable Point DP A and Dispatchable Point DP2 and on Track TK2 between Dispatchable Point DP 3 and Dispatchable Point DP D. The Office Segment 112 and/or the On-Board Segment 110 of TR1 may be programmed and/or configured to add the Crossover Track XTK (i.e., Reverse Leg RL1 or Reverse Leg RL2) to the Authority Data and/or Train Authority Data for Train TR1 (i.e., ADD XTK FOR TR1), because the authority limits contained in the Authority Data and/or the Train Authority Data for Train TR1 includes Authority AUTH1 for at least a portion of Track Segment TKS1, at least a portion of the Normal Leg NL1, and at least a portion of the Track Segment TKS4.

With respect to the operation of Train TR2 in the non-limiting embodiment of FIG. 9(*a*), the Dispatch System 106 may provide Authority Data to the Office Segment 112 (e.g., Back Office System 108) and/or the On-Board Segment 110 of Train TR2 for the Train TR2 to travel on Track TK2 between Dispatchable Point DP C and Dispatchable Point DP3. The Office Segment 112 and/or the On-Board Segment 110 of TR2 may be programmed and/or configured not to add the Crossover Track XTK (i.e., Reverse Leg RL1 or Reverse Leg RL2) to the Authority Data and/or Train Authority Data for Train TR2, because the authority limits contained in the Authority Data and/or the Train Authority Data for Train TR2 does not include Authority AUTH2 for at least a portion of Track Segment TKS4, at least a portion of the Normal Leg NL2, and at least a portion of Track Segment TKS1.

With respect to the operation of Train TR1 in the non-limiting embodiment of FIG. 9(*b*), the Dispatch System 106 may provide Authority Data to the Office Segment 112 (e.g., Back Office System 108) and/or the On-Board Segment 110 of Train TR1 for the Train TR1 to travel on Track TK1 between Dispatchable Point DP A and Dispatchable Point DP B. The Office Segment 112 and/or the On-Board Segment 110 of Train TR1 may be programmed and/or configured not to add Crossover Track XTK (i.e., Reverse Leg RL1 or Reverse Leg RL2) to the Authority Data and/or Train Authority Data for Train TR1, because the authority limits contained in the Authority Data and/or the Train Authority Data for Train TR1 does not include Authority AUTH1 for at least a portion of Track Segment TKS4.

With respect to the operation of Train TR2 in the non-limiting embodiment of FIG. 9(*b*), the Dispatch System 106 may provide Authority Data to the Office Segment 112 (e.g., Back Office System 108) and/or the On-Board Segment 110 of Train TR2 for the Train TR2 to travel on Track TK2 between Dispatchable Point DP C and Dispatchable Point DP D. The Office Segment 112 and/or the On-Board Segment 110 of Train TR2 may be programmed and/or configured not to add Crossover Track XTK (i.e., Reverse Leg RL1 or Reverse Leg RL2) to the Authority Data and/or Train Authority Data for Train TR2, because the authority limits contained in the Authority Data and/or the Train Authority Data for Train TR2 does not include Authority AUTH2 for at least a portion of Track Segment TKS1.

In the non-limiting exemplary embodiments of adding switch legs and/or crossover tracks illustrated in FIGS. 10(*a*)-(*b*) and FIGS. 11(*a*)-(*b*), the Office Segment 112, and/or the On-Board Segment 110 may be programmed and/or configured to add a switch leg of a switch to the authority limits of a railway vehicle, when the railway vehicle holds authority, such as, for example, form-based authority on the facing side of the switch including a point of switch of that switch and on the track in advance of a clearance point on a switch leg of the switch, including the clearance point, if the switch leg of the switch is not already included in the railway vehicle's existing authority. Alternatively, the Office Segment 112 and/or the On-Board Segment 110 may be programmed and/or configured to also add a switch leg of a switch to the authority limits of a railway vehicle, when the railway vehicle holds authority, such as, for example, form-based authority on the facing side of the switch including a point of switch of that switch and the track in advance of the clearance point on a switch leg of the switch including the clearance point, is uncontrolled, if the switch leg of the switch is not already included in the railway vehicle's existing authority.

With respect to the non-limiting exemplary embodiment of FIGS. 10(*a*)-(*b*), the Office Segment 112, and/or the On-Board Segment 110 of Train TR may be programmed and/or configured to determine, based on Authority Data and/or Train Authority Data, whether authority limits for Train TR includes at least a portion of Track Segment TKS1 including the Point of Switch PSW, at least a portion of Track Segment TKS2 including Clearance Point Normal Mark or Fix CPN, at least a portion of Track Segment TKS3 including Clearance Point Reverse Mark or Fix CPR, the Reverse Leg RL, and/or the Normal Leg NL. Additionally, the On-Board Segment 110 of Train TR may be further programmed and/or configured to determine whether at least a portion of Track Segment TKS2 including Clearance Point Normal Mark or Fix CPN and/or at least a portion of Track Segment TKS3 including Clearance Point Reverse Mark or Fix CPR, is uncontrolled based on the Track Data.

In the non-limiting exemplary embodiment of FIG. 10(*a*), if authority limits for Train TR includes authority for at least a portion of Track Segment TKS1 including the Point of Switch PSW and at least a portion of Track Segment TKS3 including the Clearance Point Reverse Mark or Fix CPR, then the Office Segment 112 and/or the On-Board Segment 110 of Train TR may be programmed and/or configured to add the Reverse Leg RL to the Train Authority Data for Train TR, if the Reverse Leg RL of the Switch SW is not already included in the Train TR's existing authority. Alternatively, if authority limits for Train TR includes authority for at least a portion of Track Segment TKS1 including the Point of Switch PSW and at least a portion of the Track Segment TKS3, including Clearance Point Reverse Mark or Fix CPR, is uncontrolled, then the Office Segment 112 and/or the On-Board Segment 110 of Train TR may be programmed and/or configured to add the Reverse Leg RL to the Train Authority Data for Train TR, if the Reverse Leg RL of the Switch SW is not already included in the Train TR's existing authority. It will be appreciated that while authority limits for Train TR may include authority for at least a portion of Normal Leg NL, the Office Segment 112 and/or the On-Board Segment 110 of Train TR may be programmed and/or configured to add Reverse Leg RL to the Train Authority Data regardless of whether authority limits for Train TR includes authority for the Normal Leg NL, as long as the authority limits for Train TR includes Point of Switch PSW.

With respect to the operation of Train TR in the non-limiting embodiment of FIG. 10(*a*), the Dispatch System 106 may provide Authority Data to the Office Segment 112 (e.g., Back Office System 108) and/or the On-Board Segment 110 of Train TR for the Train TR to travel on Track TK between Dispatchable Point DP A and Dispatchable Point DP2 and on Siding Track STK between Dispatchable Point DP3 and Dispatchable Point DP C. The Office Segment 112 and/or the On-Board Segment 110 of Train TR may be programmed and/or configured to add Reverse Leg RL to the Train Authority Data for Train TR (i.e., ADD RL FOR TR), because the authority limits contained in the Authority Data and/or the Train Authority Data for Train TR includes Authority AUTH for at least a portion of Track Segment TKS1 including the Point of Switch PSW, at least a portion of Track Segment TKS3 including the Clearance Point Reverse Mark or Fix CPR, and the Reverse Leg RL is not already in the authority limits for Train TR.

With continued reference to the operation of Train TR in the non-limiting embodiment of FIG. 10(*a*), the Dispatch System 106 may provide Authority Data to the Office Segment 112 (e.g., Back Office System 108) and/or the On-Board Segment 110 of Train TR for the Train TR to travel on Track TK between Dispatchable Point DP A and Dispatchable Point DP2. However, the Siding Track STK between Dispatchable Point DP3 and Dispatchable Point DP C is uncontrolled. The Office Segment 112 and/or the On-Board Segment 110 of Train TR may be programmed and/or configured to add Reverse Leg RL to the Train Authority Data for Train TR, because the authority limits contained in the Authority Data and/or the Train Authority Data for Train TR includes Authority AUTH for at least a portion of Track Segment TKS1 including the Point of Switch PSW, at least a portion of Track Segment TKS3 including the Clearance Point Reverse Mark or Fix CPR, is uncontrolled based on Track Data, and the Reverse Leg RL is not already in the authority limits for Train TR.

With respect to the operation of Train TR in the non-limiting embodiment of FIG. 10(*b*), Dispatch System 106 may provide Authority Data to the Office Segment 112 (e.g., Back Office System 108) and/or the On-Board Segment 110 of Train TR for the Train TR to travel on Track TK between Dispatchable Point DP A and Dispatchable Point DP B. The Office Segment 112 and/or the On-Board Segment 110 may be programmed and/or configured not to add Normal Leg NL to the Train Authority Data for Train TR, because the authority limits contained in the Authority Data and/or the Train Authority Data for Train TR already include Authority AUTH for Normal Leg NL.

With continued reference to the operation of Train TR in the non-limiting embodiment of FIG. 10(*b*), Dispatch System 106 may alternatively provide Authority Data to the Office Segment 112 (e.g., Back Office System 108) and/or the On-Board Segment 110 of Train TR for Train TR to travel on Track TK between Dispatchable Point DP DP A and Dispatchable Point DP2. However, Track TK between Dispatchable Point DP2 and Dispatchable Point DP B may be uncontrolled with respect to Train TR. The Office Segment 112 and/or the On-Board Segment 110 may also be programmed and/or configured not to add Reverse Leg RL to the Train Authority Data for Train TR, because the authority limits contained in the Authority Data and/or the Train Authority Data for Train TR do not include Authority AUTH for Track Segment TKS3 and Clearance Point Reverse Mark or Fix CPR and because the Track Segment TKS3 including the Clearance Point Reverse Mark or Fix CPR is controlled.

With respect to Train TR1 in the non-limiting exemplary embodiment of FIGS. 11(*a*)-(*b*), the Office Segment 112 and/or the On-Board Segment 110 of Train TR1 may be programmed and/or configured to determine, based on Authority Data and/or Train Authority Data, whether authority limits for Train TR1 includes at least a portion of Track Segment TKS1 including the Point of Switch PSW1, at least a portion of Track Segment TKS2 including Clearance Point Normal Mark or Fix CPN1, at least a portion of Track Segment TKS4 including Clearance Point Reverse Mark or Fix CPR1, Normal Leg NL1, and Crossover Track XTK (i.e., Reverse Leg RL1 or Reverse Leg RL2). Additionally, the Office Segment 112 and/or the On-Board Segment 110 of Train TR1 may be further programmed and/or configured to determine, based on Track Data, whether Track Segment TKS4 including Clearance Point Reverse Mark or Fix CPR1 and/or Track Segment TKS2 including Clearance Point Normal Mark or Fix CPN1 is uncontrolled.

With continued reference to Train TR1 in the non-limiting exemplary embodiment of FIGS. 11(*a*)-(*b*), the Office Segment 112 and/or the On-Board Segment 110 of Train TR1 may be programmed and/or configured to add the Crossover Track XTK (i.e., Reverse Leg RL1 or Reverse Leg RL2) to the Train Authority Data for Train TR1, if authority limits for Train TR1 include authority for at least a portion of Track Segment TKS1 including the Point of Switch PSW1 and at least a portion of Track Segment TKS4 including the Clearance Point Reverse Mark or Fix CPR1 and the Crossover Track XTK is not already included in the Train TR1's existing authority. Additionally, the Office Segment 112 and/or the On-Board Segment 110 may also be programmed and/or configured to add the Crossover Track XTK to the Train Authority Data for Train TR1, if authority limits for Train TR1 includes authority for at least a portion of Track Segment TKS1 including the Point of Switch PSW1 and at least a portion of the Track Segment TKS4 including Clearance Point Reverse Mark or Fix CPR1, is uncontrolled, and the Crossover Track XTK is not already included in the Train TR1's existing authority.

With respect to Train TR2 in the non-limiting exemplary embodiment of FIGS. 11(*a*)-(*b*), the Office Segment 112 and/ or the On-Board Segment 110 of Train TR2 may be programmed and/or configured to determine, based on Authority Data and/or Train Authority Data, whether authority limits for Train TR2 includes authority for at least a portion of Track Segment TKS3 including Clearance Point Normal CPN2, at least a portion of Track Segment TKS4 including the Point of Switch PSW2, at least a portion of Track Segment TKS1 including Clearance Point Reverse Mark or Fix CPR2, Normal Leg NL2, and Crossover Track XTK (i.e., Reverse Leg RL1 or Reverse Leg RL2). Additionally, the Office Segment 112 and/or the On-Board Segment 110 of Train TR2 may be further programmed and/or configured to determine, based on Track Data, whether Track Segment TKS1 including Clearance Point Reverse Mark or Fix CPR2 and/or Track Segment TKS3 including Clearance Point Normal Mark or Fix CPN2, is uncontrolled.

With continued reference to Train TR2 in the non-limiting exemplary embodiment of FIGS. 11(*a*)-(*b*), the Office Segment 112 and/or the On-Board Segment 110 of Train TR2 may be programmed and/or configured to add the Crossover Track XTK (i.e., Reverse Leg RL1 or Reverse Leg RL2) to the Train Authority Data for Train TR2, if authority limits for Train TR2 include authority for at least a portion of Track Segment TKS4 including the Point of Switch PSW2 and at least a portion of Track Segment TKS1 including the Clearance Point Reverse Mark or Fix CPR2, and the Crossover Track XTK is not already included in the Train TR2's existing authority. Additionally, the Office Segment 112 and/or the On-Board Segment 110 may be programmed and/or configured to add the Crossover Track XTK (i.e., Reverse Leg RL1 or Reverse Leg RL2) to the Train Authority Data for Train TR2, if authority limits for Train TR2 include authority for at least a portion of Track Segment TKS4 including the Point of Switch PSW2 and the Track Segment TKS1 including Clearance Point Reverse Mark or Fix CPR2, is uncontrolled and the Crossover Track XTK is not already included in the Train TR2's existing authority.

With respect to the operation of Train TR1 in the non-limiting embodiment of FIG. 11(*a*), the Dispatch System 106 may be programmed and/or configured to provide Authority Data to the Office Segment 112 (e.g., Back Office System 108) and/or the On-Board Segment 110 of Train TR1 for the Train TR1 to travel on Track TK1 between Dispatchable Point DP A and Dispatchable Point DP2 and on Track TK2 between Dispatchable Point DP3 and Dispatchable Point DP D. The Office Segment 112 and/or the On-Board Segment 110 may be programmed and/or configured to add the Crossover Track XTK (i.e., Reverse Leg RL1 or Reverse Leg RL2) to the Train Authority Data for Train TR1 (i.e., ADD XTK FOR TR1), because the authority limits contained in the Authority Data and/or the Train Authority Data for Train TR1 include Authority AUTH1 for at least a portion of Track Segment TKS1 including Point of Switch PSW1 and at least a portion of Track Segment TKS4 including Clearance Point Reverse Mark or Fix CPR1.

With continued reference to the operation of Train TR1 in the non-limiting embodiment of FIG. 11(*a*), the Dispatch System 106 may alternatively provide Authority Data to the Office Segment 112 (e.g., Back Office System 108) and/or the On-Board Segment 110 of Train TR1 for the Train TR1 to travel on Track TK1 between Dispatchable Point DP A and Dispatchable Point DP2. However, Track TK2 between Dispatchable Point DP3 and Dispatchable Point DP D may be uncontrolled with respect to Train TR1. The Office Segment 112 and/or the On-Board Segment 110 of Train TR1 may be programmed and/or configured to add Crossover Track XTK to the Train Authority Data for Train TR1, because the authority limits contained in the Authority Data and/or the Train Authority Data for Train TR1 include Authority AUTH1 for at least a portion of Track Segment TKS1 including Point of Switch PSW1 and the Track Data indicates that at least a portion of Track Segment TKS4 including Clearance Point Reverse Mark or Fix CPR1 is uncontrolled.

With respect to the operation of Train TR2 in the non-limiting embodiment of FIG. 11(*a*), the Dispatch System 106 may be programmed and/or configured to provide Authority Data to the Office Segment 112 (e.g., Back Office System 108) and/or the On-Board Segment 110 of Train TR2 for the Train TR2 to travel on Track TK2 between Dispatchable Point DP C and Dispatchable Point DP3. The Office Segment 112 and/or the On-Board Segment 110 of Train TR2 may be programmed and/or configured not to add the Crossover Track XTK (i.e., Reverse Leg RL1 or Reverse Leg RL2) to the Train Authority Data for Train TR2, because the authority limits contained in the Authority Data and/or the Train Authority Data for Train TR2 do not include Authority AUTH2 for at least a portion of Track Segment TKS4 including Point of Switch PSW2 and at least a portion of Track Segment TKS1 including Clearance Point Reverse Mark or Fix CPR2. Additionally, the Office Segment 112 and/or the On-Board Segment 110 of Train TR2 may also be programmed and/or configured not to add the Crossover Track XTK to the Train Authority Data for Train TR2, because the authority limits contained in the Authority Data and/or the Train Authority Data for Train TR2 do not include Authority AUTH2 for at least a portion of Track Segment TKS4 including Point of Switch PSW2 and the Track Data does not indicate that at least a portion of Track Segment TKS1 including Clearance Point Reverse Mark or Fix CPR2 is uncontrolled.

With respect to the operation of Train TR1 in the non-limiting embodiment of FIG. 11(*b*), the Dispatch System 106 may be programmed and/or configured to provide Authority Data to the Office Segment 112 (e.g., Back Office System 108) and/or the On-Board Segment 110 of Train TR1 for the Train TR1 to travel on Track TK1 between Dispatchable Point DP A and Dispatchable Point DP B. The Office Segment 112 and/or the On-Board Segment 110 of Train TR1 may be programmed and/or configured not to add the Crossover Track XTK (i.e., Reverse Leg RL1 or Reverse Leg RL2) to the Train Authority Data for Train TR1, because the authority limits contained in the Authority Data and/or the Train Authority Data for Train TR1 does not include Authority AUTH1 for at least a portion of Track Segment TKS4 including Clearance Point Reverse Mark or Fix CPR1. Additionally, the Office Segment 112 and/or the On-Board Segment 110 of Train TR1 may be programmed and/or configured not to add the Normal Leg NL1 to the Train Authority Data for Train TR1, because the authority limits contained in the Authority Data and/or the Train Authority Data already includes Authority AUTH1 for the Normal Leg NL1 even though authority limits for Train TR1 includes Authority AUTH1 for at least a portion of Track Segment TKS1 including Point of Switch PSW1 and at least a portion of Track Segment TKS2 including Clearance Point Normal Mark or Fix CPN1.

With continued reference to the operation of Train TR1 in the non-limiting embodiment of FIG. 11(*b*), the Dispatch System 106 may be alternatively programmed and/or configured to provide Authority Data to the Office Segment 112 (e.g., Back Office System 108) and/or the On-Board Segment 110 of Train TR1 for the Train TR1 to travel on Track TK1 between Dispatchable Point DP A and Dispatchable Point DP2. However, Track Segment TKS2 including Clearance Point Normal Mark or Fix CPN1 is uncontrolled. The Office Segment 112 and/or the On-Board Segment 110 of Train TR1 may be programmed and/or configured not to add the Crossover Track XTK (i.e., Reverse Leg RL1 or Reverse Leg RL2) to the Train Authority Data for Train TR1, because the authority limits contained in the Authority Data and/or the Train Authority Data for Train TR1 does not include Authority AUTH1 for at least a portion of Track Segment TKS4 including Clearance Point Reverse Mark or Fix CPR1. Additionally, the Office Segment 112 and/or the On-Board Segment 110 of Train TR1 may be programmed and/or configured not to add the Normal Leg NL1 to the Train Authority Data for Train TR1, because the authority limits contained in the Authority Data and/or the Train Authority Data already includes Authority AUTH1 for the Normal Leg NL1 even though authority limits for Train TR1 includes Authority AUTH1 for at least a portion of Track Segment TKS1 including Point of Switch PSW1 and Track Segment TKS2 including Clearance Point Normal Mark or Fix CPN1 is uncontrolled.

With respect to the operation of Train TR2 in the non-limiting embodiment of FIG. 11(*b*), the Dispatch System 106 may provide Authority Data to the Office Segment 112 (e.g., Back Office System 108) and/or the On-Board Segment 110 of Train TR2 for the Train TR2 to travel on Track TK2 between Dispatchable Point DP C and Dispatchable Point DP D. The Office Segment 112 and/or the On-Board Segment 110 of Train TR2 may be programmed and/or configured not to add the Crossover Track XTK (i.e., Reverse Leg RL1 or Reverse Leg RL2) to the Train Authority Data for Train TR2, because the authority limits contained in the Authority Data and/or the Train Authority Data for Train TR2 does not include Authority AUTH2 for at least a portion of Track Segment TKS1 including Clearance Point Reverse Mark or Fix CPR2. Additionally, the Office Segment 112 and/or the On-Board Segment 110 of Train TR2 may be programmed and/or configured not to add the Normal Leg NL2 to the Train Authority Data for Train TR2, because the authority limits contained in the Authority Data and/or the Train Authority Data already includes Authority AUTH2 for the Normal Leg NL2 even though authority limits for Train TR2 includes Authority AUTH2 for at least a portion of Track Segment TKS4 including Point of Switch PSW2 and at least a portion of Track Segment TKS3 including Clearance Point Normal Mark or Fix CPN2.

With continued reference to the operation of Train TR2 in the non-limiting embodiment of FIG. 11(*b*), the Dispatch System 106 may provide Authority Data to the Office Segment 112 (e.g., Back Office System 108) and/or the On-Board Segment 110 of Train TR2 for the Train TR2 to travel on Track TK2 between Dispatchable Point DP3 and Dispatchable Point DP D and Track Segment TKS3 including Clearance Point Normal Mark or Fix CPN2 is uncontrolled. The Office Segment 112 and/or the On-Board Segment 110 of TR2 may be programmed and/or configured not to add the Crossover Track XTK (i.e., Reverse Leg RL1 or Reverse Leg RL2) to the Train Authority Data for Train TR2, because the authority limits contained in the Authority Data and/or the Train Authority Data for Train TR2 does not include Authority AUTH2 for at least a portion of Track Segment TKS1 including Clearance Point Reverse Mark or Fix CPR2. Additionally, the Office Segment 112 and/or the On-Board Segment 110 may be programmed and/or configured not to add the Normal Leg NL2 to the Train Authority Data for Train TR2, because the authority limits contained in the Authority Data and/or the Train Authority Data already includes Authority AUTH2 for the Normal Leg NL2 even though authority limits for Train TR2 includes Authority AUTH2 for at least a portion of Track Segment TKS4 including Point of Switch PSW2 and Track Segment TKS3 including Clearance Point Normal Mark or Fix CPN2 is uncontrolled.

Figure 12:
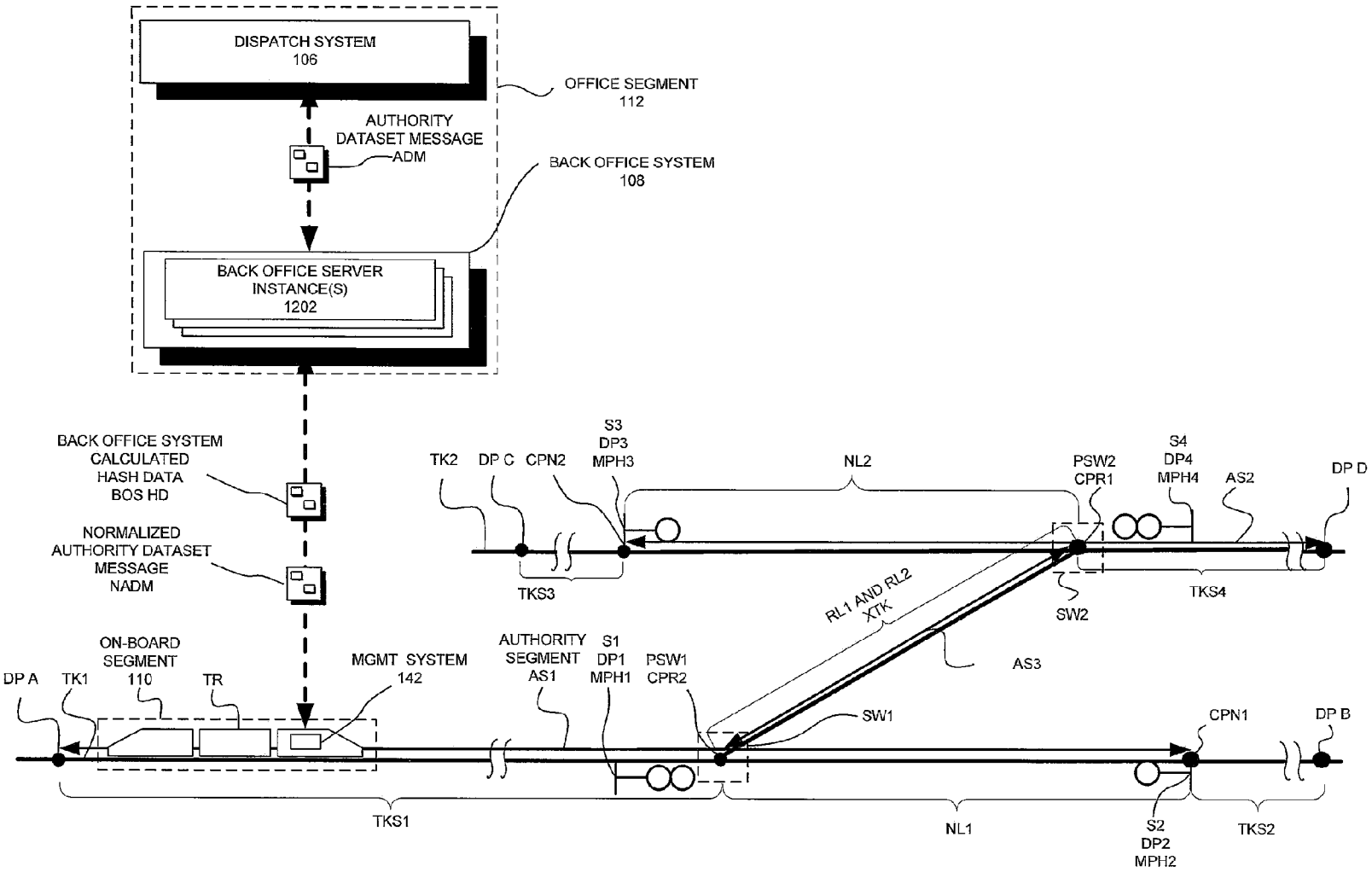
FIG. 12 is a schematic view of one non-limiting exemplary embodiment of the system and method for transforming movement authority limits in a particular track and feature arrangement according to the principles of the present invention.

FIG. 12 is a schematic view of one preferred and non-limiting exemplary embodiment of the system and method for transforming movement authority limits in a particular track and feature arrangement. As previously discussed, the Office Segment 112 may include, but is not limited to a Dispatch System 106, which may provide authority limits in at least one Authority Dataset Message ADM to the Office Segment 112 and, in one preferred and non-limiting embodiment, the Back Office System 108, which may be programmed and/or configured to execute one or more Back Office Sever Instance (s) (and/or functions) 1202. In particular, the at least one Authority Dataset Message ADM may contain authority limits for Train TR to travel between Track TK1 and Track TK2. Thus, the at least one Authority Dataset Message ADM may contain at least Authority Segment AS1, which may provide authority between Dispatchable Point DP A and Dispatchable point DP2 and Authority Segment AS2, which may provide authority between Dispatchable point DP3 and Dispatchable Point DP D. As previously discussed, in some implementations of Dispatch System 106, the at least one Authority Dataset Message ADM may already contain authority (i.e., Authority Segment AS3) for the Crossover Track XTK (i.e., Reverse Leg RL1 or Reverse Leg RL2).

In the non-limiting exemplary embodiment of FIG. 12, the Back Office System 108, as previously discussed, may receive and store the at least one Authority Dataset Message ADM, transform the at least one Authority Dataset Message ADM into Train Authority Data, and/or normalize the at least one Authority Dataset Message ADM for transmission to Train TR. Additionally, the Back Office System 108 may be programmed and/or configured to calculate Hash Data based on Train Authority Data either with or without adding any switch legs and transmit the Back Office System Calculated Hash Data BOS HD to the Train TR. Furthermore, the Back Office System 108 may be programmed and/or configured to normalize the at least one Authority Dataset Message ADM and transmit the Normalized Authority Dataset Message NADM either directly or indirectly to the Train TR, which may be stored and further processed by the On-Board Segment 110 and in particular, the Management System 142 of Train TR.

With continued reference to the non-limiting exemplary embodiment of FIG. 12, it will be appreciated that in some implementations, the Dispatch System 106 may provide authority limits for tracks associated with the switches in two or more authority dataset messages. In particular, some authority segments may be transmitted from the Dispatch System 106 to the Back Office System 108 in separate authority dataset messages. Additionally, in such cases, each authority dataset message may be received by different Back Office Server Instance(s) 1202. Accordingly, in these implementations, the Dispatch System 106, the Back Office System 108, and/or the Management System 142 may be programmed and/or configured to coordinate multiple authority dataset messages between Back Office Server Instance(s) 1202 and the Management System 142 of Train TR. However, due to the complexity of trying to coordinate multiple authority dataset messages between and among back office systems and/or management systems of railway vehicles (taking into consideration that authorities for railway vehicles may span two or more subdivisions/districts, and each subdivision/district may be controlled by a different back office server instance), it may be impractical for some back office systems and/or on-board segments of railway vehicles to add crossover tracks over multiple authority dataset messages while still being able to reliably calculate the same hash data.

Figure 13:
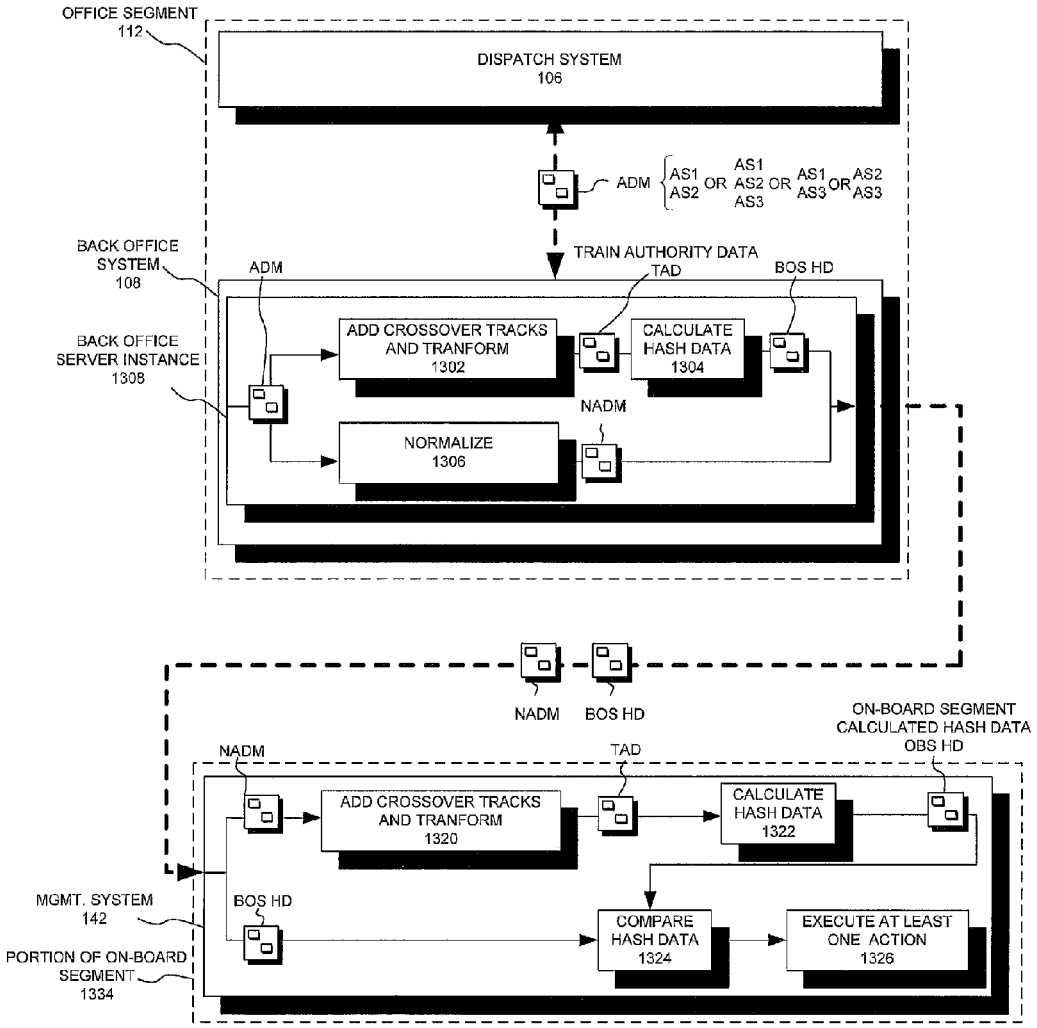
FIG. 13 is a schematic view of one non-limiting exemplary embodiments of the system and method for transforming movement authority limits and adding crossover tracks according to the non-limiting exemplary embodiments illustrated in FIGS. 9(*a*)-(*b*) for authority data provided in the particular track and feature arrangement of FIG. 12.

FIG. 13 is a schematic view of a preferred and non-limiting exemplary embodiment of the system and method for transforming movement authority limits and adding switch legs according to the non-limiting exemplary embodiments illustrated in FIGS. 9(*a*)-(*b*) for Authority Data provided in the particular track and feature arrangement of FIG. 12. In one exemplary implementation of the non-limiting exemplary embodiment of FIG. 13, the Dispatch System 106 may be programmed and/or configured to determine whether the Back Office System 108 and/or the Management System 142 are expected to add switch legs or crossover tracks with respect to Authority Data provided in one or more authority dataset messages. In particular, the Back Office System 108 may be programmed and/or configured to determine whether authority for a railway vehicle includes authority limits on the facing side of a switch and in advance of the switch on the track and in advance of the clearance point on the other track.

In the non-limiting exemplary embodiment of FIG. 13 and with reference to the particular feature and track arrangement of FIG. 12, the Dispatch System 106 may be programmed and/or configured to determine whether authority for Train TR includes at least a portion of Track Segment TKS1, Normal Leg NL1, and Track Segment TKS4, but not Crossover Track XTK (i.e., Reverse Leg RL1 and Reverse Leg RL2). If Dispatch System 106 determines that authority for Train TR includes at least a portion of Track Segment TKS1, Normal Leg NL1, and Track Segment TKS4 but does not include Crossover Track XTK, then the Dispatch System 106 may conclude that the Back Office System 108 and the Management System 142 of Train TR may be required to add Crossover Track XTK in order to provide authority for Train TR to travel between Track TK1 and Track TK2.

With reference to non-limiting exemplary embodiment of FIG. 13, if the Dispatch System 106 determines that the Management System 142 of Train TR and Back Office System 108 may be required to add Crossover Track XTK, the Dispatch System 106 may be programmed and/or configured to prevent issuing or providing authority limits in separate or fragmented authority dataset messages by for example, combining authority segments into a single Authority Dataset Message ADM, when the Back Office System 108 and/or Management System 142 are expected to add crossover tracks. Thus, the Dispatch System 106 may be programmed and/or configured to determine which authority segments are associated with Track Segment TKS1, Normal Leg NL1, and Track Segment TKS4 and combine those authority segments that provide authority to Track Segment TKS1, Normal Leg NL1, and Track Segment TKS4 into a single Authority Dataset Message ADM. In the non-limiting exemplary embodiment of FIG. 13, the Dispatch System 106 may be programmed and/or configured to combine Authority Segment AS1 and Authority Segment AS2 into a single Authority Dataset Message ADM and transmit the single Authority Dataset Message ADM to the Back Office System 108 as illustrated in FIG. 13.

With continued reference to non-limiting exemplary embodiment of FIG. 13, the Dispatch System 106 may be alternatively programmed and/or configured to explicitly include the crossover track in one authority dataset message for transmission to the Back Office System 108 and/or the Management System 142, if the Dispatch System 106 determines that the Management System 142 of Train TR and/or Back Office System 108 may be required to add crossover track. Thus, with reference to Authority Data provided in the particular track and feature arrangement of FIG. 12, the Dispatch System 106 may be alternatively programmed and/or configured to include: Authority Segment AS1, Authority Segment AS2, and Authority Segment AS3 in a single Authority Dataset Message ADM; Authority Segment AS1 and Authority Segment AS3 in a single Authority Dataset Message ADM; or Authority Segment AS2 and Authority Segment AS3 in a single Authority Dataset Message ADM for transmission to the Back Office System 108. Additionally, as previously discussed, in implementations where the Dispatch System 106 is programmed and/or configured to explicitly include the Crossover Track XTK, the Dispatch System 106 may also be programmed and/or configured to add switch legs or crossover tracks in order to provide authority to switch legs or crossover tracks by using non-limiting exemplary embodiments disclosed with respect to FIGS. 9(*a*)-(*b*), FIGS. 10(*a*)-(*b*), and/or FIGS. 11(*a*)-(*b*).

With continued reference to non-limiting exemplary embodiment of FIG. 13, the Back Office System 108 may include at least one Back Office Server Instance 1308, which may be programmed and/or configured to receive at least one Authority Dataset Message ADM and Add Crossover Tracks and Transform 1302 based on the received at least one Authority Data Message ADM. In particular, the Back Office System 108 may be programmed and/or configured to add crossover tracks in accordance with non-limiting exemplary embodiment disclosed in FIGS. 9(*a*)-(*b*) and transform the Authority Dataset Message ADM including any switch legs or crossover tracks into Train Authority Data TAD. Moreover, with respect to adding crossover tracks, the Back Office System 108 may be programmed and/or configured to add crossover tracks based on and in response to receiving a single Authority Dataset Message ADM that contains authority limits on the facing side of a switch and in advance of the switch on one track and in advance of the clearance point on the other track. The Back Office System 108 may be programmed and/or configured to add a crossover track in accordance with the non-limiting exemplary embodiment disclosed in FIGS. 9(*a*)-(*b*), only if the single Authority Dataset Message ADM for the railway vehicle contains authority limits on the facing side of a switch and in advance of the switch on one track and in advance of the clearance point on the other track. However, it will be appreciated that in cases when the single Authority Dataset Message ADM already includes authority limit for the crossover track, the Back Office System 108 may be programmed and/or configured not to add that crossover track but still transform the received Authority Data into Train Authority Data.

Thus, in the non-limiting exemplary embodiment of FIG. 13 and with reference to the particular track and feature arrangement of FIG. 12, the Back Office System 108 may be configured to determine whether the single Authority Dataset Message ADM contains authority limits for at least a portion of Track Segment TKS1, Normal Leg NL1, and Track Segment TKS4. The Back Office System 108 may be programmed and/or configured to add Crossover Track XTK in accordance with the non-limiting exemplary embodiment disclosed in FIGS. 9(*a*)-(*b*), only if the single Authority Dataset Message ADM contains authority limits for at least a portion of Track Segment TKS1, Normal Leg NL1, and Track Segment TKS4. Therefore, in the non-limiting exemplary embodiment of FIG. 13, when the single Authority Dataset Message ADM contains Authority Segment AS1 and Authority Segment AS2, the Back Office System 108 may be programmed and/or configured to add Crossover Track XTK in accordance with the non-limiting exemplary embodiment disclosed in FIGS. 9(*a*)-(*b*), because the Authority Segment AS1 provides authority for at least a portion of Track Segment TKS1 and at least a portion of Normal Leg NL1; and the Authority Segment AS2 provides authority for at least a portion of Track Segment TKS4.

In the non-limiting exemplary embodiment of FIG. 13, the Back Office System 108 may be further programmed and/or configured to Calculate Hash Data 1304 based on the Train Authority Data TAD in accordance with a hash function and transmit the Back Office System Calculated Hash Data BOS HD either directly or indirectly to at least a Portion of the On-Board Segment 1334 and in particular, the Management System 142. Additionally and as previously discussed, the Back Office System 108 may also be programmed and/or configured to Normalize 1306 the Authority Dataset Message ADM received from the Dispatch System 106 and transmit a Normalized Authority Dataset Message NADM to the Management System 142.

With continued reference to the non-limiting exemplary embodiment of FIG. 13, the Management System 142 may be programmed and/or configured to receive the normalized authority dataset messages from the Back Office System 108 and Add Crossover Tracks and Transform 1320 utilizing similar steps discussed above with respect Add Crossover Tracks and Transform 1302 in the Back Office System 108. In particular, the Management System 142 may be programmed and/or configured to add crossover tracks based on and in response to a single Normalized Authority Dataset Message NADM received from Back Office System 108 that contains authority limits on the facing side of a switch and in advance of the switch on one track and in advance of the clearance point on the other track. Additionally, the Management System 142 may be configured to transform the single Normalized Authority Dataset Message NADM including any crossover tracks into Train Authority Data TAD. The Management System 142 may be programmed and/or configured to Calculate Hash Data 1322 based on the Train Authority Data TAD in accordance with the same hash function executed by the Back Office System 108, and Compare Hash Data 1324 to determine whether a transformation error has occurred. In particular, the Management System 142 may be programmed and/or configured to compare the On-Board Segment Calculated Hash Data OBS HD with the Back Office System Calculated Hash Data BOS HD received from the Back Office System 108 in order to determine whether a transformation error and/or inconsistency has occurred. Furthermore and as previously discussed, the Management System 142 may be configured to Execute At Least One Action 1326 based at least partially on whether a transformation error has occurred.

Several advantages are realized in the non-limiting exemplary embodiment illustrated in FIG. 13. One advantage is the reduction of complexity of trying to coordinate multiple authority datasets between the back office systems and on-board segments of various railway vehicles taking into account that authorities for one or more railway vehicles may span subdivisions/districts that may not be controlled by the same back office server instance. This, in turn, may make it difficult or impractical for the back office systems and on-board segments to add switch legs or crossover tracks over multiple authority dataset messages and determine the same hash data, reliably. Another advantage is the elimination of unintended overlaps of switch legs or crossover tracks, resulting in reducing or eliminating changes to the transformation checking requirements in the back office systems. Still another advantage is the reliable addition of switch legs or crossover tracks in the back office systems and the on-board segments of railway vehicles by not allowing dispatch systems to issue separate authority dataset messages when the back office systems and on-board segments are expected to add crossover tracks or by ensuring that the dispatch system explicitly includes the crossover tracks in one authority dataset message.

Figure 14:
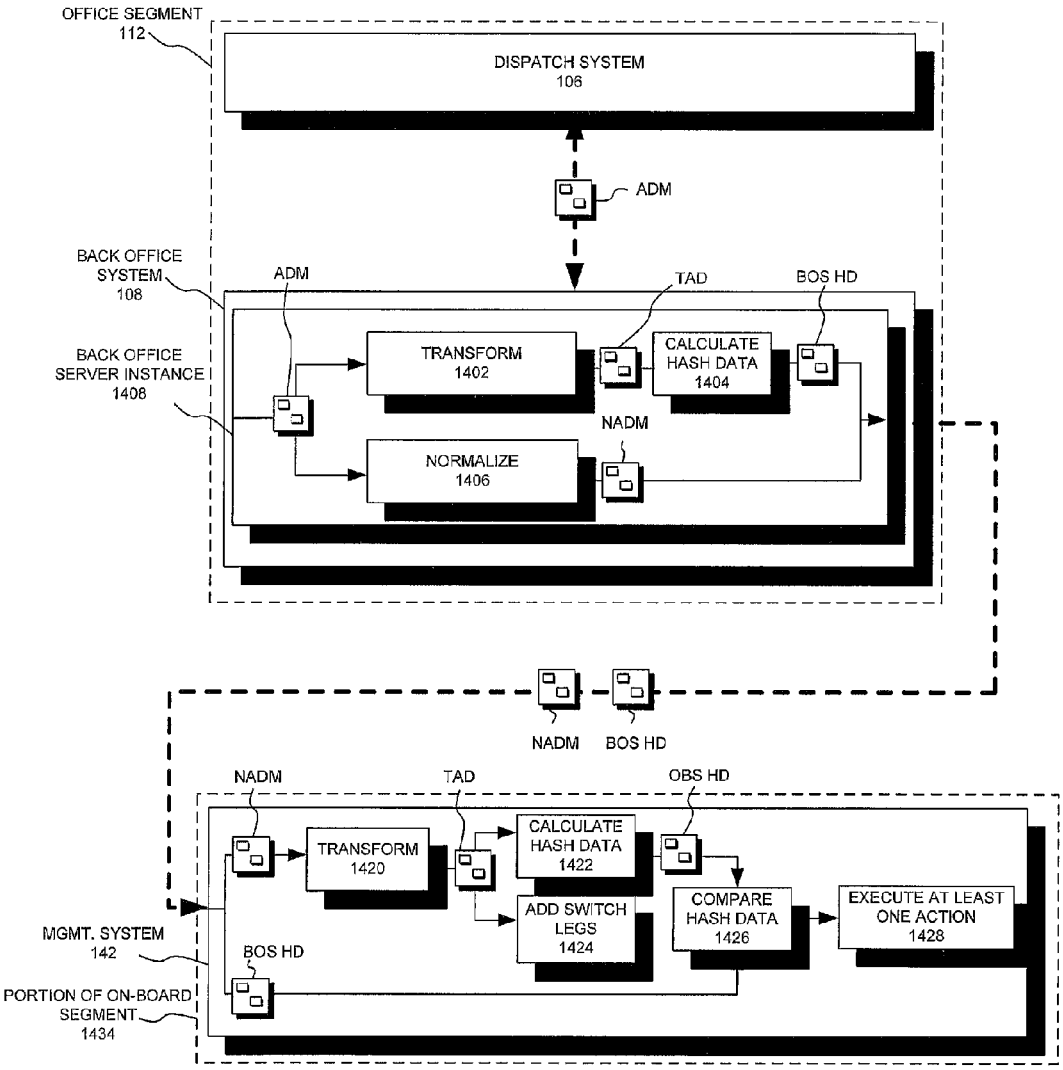
FIG. 14 is a schematic view of non-limiting exemplary embodiment of the system and method for transforming movement authority limits and adding switch legs or crossover tracks according to FIGS. 10(*a*)-(*b*) and FIGS. 11(*a*)-(*b*) for authority data provided in the particular track and feature arrangement of FIG. 12.

FIG. 14 is a schematic view of another preferred and non-limiting exemplary embodiment of the system and method for transforming movement authority limits and adding switch legs according to non-limiting exemplary embodiments of FIGS. 10(*a*)-(*b*) and FIGS. 11(*a*)-(*b*) for Authority Data provided in the particular track and feature arrangement of FIG. 12. In the non-limiting exemplary embodiment of FIG. 14, the Dispatch System 106 may be programmed and/or configured to provide Authority Data in at least one Authority Dataset Message ADM. The Authority Dataset Message ADM may contain Authority Segment AS1, Authority Segment AS2, Authority Segment AS3, or any combination thereof. In one non-limiting example, a first Authority Dataset Message ADM may contain only Authority Segment AS1 while a second Authority Dataset Message ADM may contain only Authority Segment AS2.

In some implementations of the non-limiting exemplary embodiment of FIG. 14, the Back Office System 108 may include at least one Back Office Server Instance 1408 and may be programmed and/or configured receive and store Authority Data provided in one or more authority dataset messages. Furthermore, the Back Office System 108 may be programmed and/or configured to only Transform 1402 the received Authority Data Message ADM into Train Authority Data TAD. In such implementations, the Back Office System 108 may be further programmed and/or configured to Calculate Hash Data 1404 based on the Train Authority Data TAD in accordance with a hash function and transmit the Back Office System Calculated Hash Data BOS HD either directly or indirectly to at least a Portion of the On-Board Segment 1434 and in particular, the Management System 142. In addition, and as previously discussed, the Back Office System 108 may also Normalize 1406 the Authority Dataset Message ADM received from the Dispatch System 106 and transmit a Normalized Authority Dataset Message NADM to the Management System 142.

In some implementations of the non-limiting exemplary embodiment of FIG. 14, at least a Portion of the Management System 142 may be programmed and/or configured as a vital or safety critical element. The Management System 142 may be further programmed and/or configured to receive the normalized authority dataset messages from the Back Office System 108 and Transform 1420 the received Normalized Authority Dataset Message NADM into Train Authority Data TAD. The Management System 142 may be programmed and/or configured to Calculate Hash Data 1422 based on the Train Authority Data TAD in accordance with the same hash function executed by the Back Office System 108, and Compare Hash Data 1426 to determine whether a transformation error has occurred. In particular, the Management System 142 may be programmed and/or configured to compare the On-Board Segment Calculated Hash Data OBS HD with the Back Office System Calculated Hash Data BOS HD received from the Back Office System 108 in order to determine whether a transformation error has occurred. Additionally, the Management System 142 may be configured to Execute At Least One Action 1428 based at least partially on whether a transformation error has occurred.

After transforming the authority limits provided in a Normalized Authority Dataset Message NADM and comparing the Back Office Calculated Hash Data BOS HD with On-Board Segment Calculated Hash Data OBS HD, the Management System 142 may be programmed and/or configured to Add Switch Legs 1424 in a vital or safety critical manner based on the Train Authority Data in accordance with the non-limiting exemplary embodiments of FIGS. 10(*a*)-(*b*) and FIGS. 11(*a*)-(*b*). Therefore, in some implementations, the non-limiting exemplary embodiments of FIGS. 10(*a*)-(*b*) and 11(*a*)-(*b*) may be implemented using vital or safety critical elements. Additionally, it will be appreciated that the Management System 142 may be programmed and/or configured to Add Switch Legs 1424 after one or more Normalized Authority Dataset Messages NADM has been transformed into Train Authority Data TAD. Alternatively, the addition of switch legs or crossover tracks may be determined based on whether a transformation error has occurred. Accordingly, while not illustrated in the non-limiting exemplary embodiment of FIG. 14, the Management System 142 may be programmed and/or configured to Add Switch Legs 1424 after the Management System 142 concludes that no transformation error has occurred.

Several advantages are realized in the non-limiting exemplary embodiment illustrated in FIG. 14. One advantage is the reduction of complexity of trying to coordinate multiple authority datasets between the back office systems and on-board segments of various railway vehicles taking into account that authorities for one or more railway vehicles may span subdivisions/districts. Another advantage is the elimination of unintended overlaps of switch legs or crossover tracks, and thus, reducing or eliminating changes to the transformation checking requirements in the back office systems. Yet another advantage is the simplification of calculating hash data which may require coordination between the on-board segment and multiple back office system vendors. Moreover, the simplification of hash data calculation is possible, in part, because the responsibility of adding switch legs or crossover tracks before calculating hash data has been removed from the back office systems. Moreover, because the on-board segment may add switch legs or crossover tracks in a vital or safety critical manner, it is no longer necessary to check these computations with the back office systems and consequently, reducing overall complexity of the non-limiting exemplary embodiment of FIG. 14.

Figure 15A:
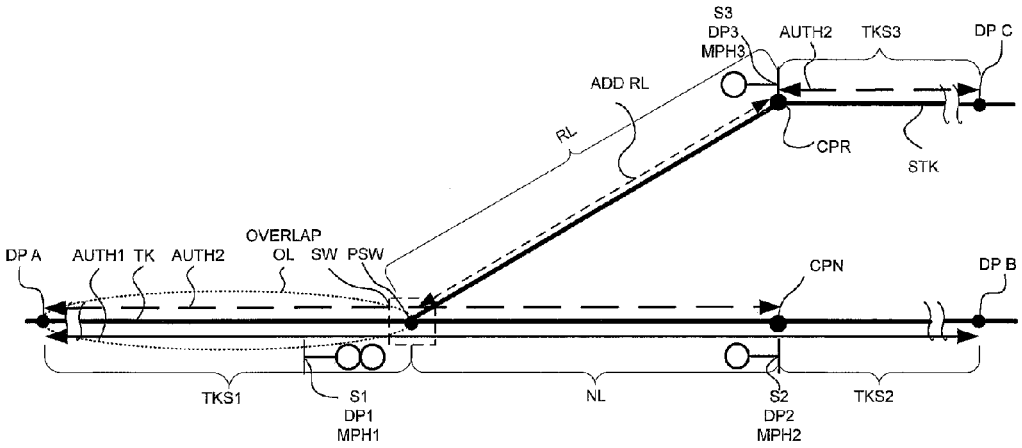
FIGS. 15(*a*)-(*b*) are schematic views of non-limiting exemplary embodiments of system and method for transforming movement authority limits and detecting conflicts or overlaps between two or more railway vehicles according to the principles of the present invention.
Figure 15B:
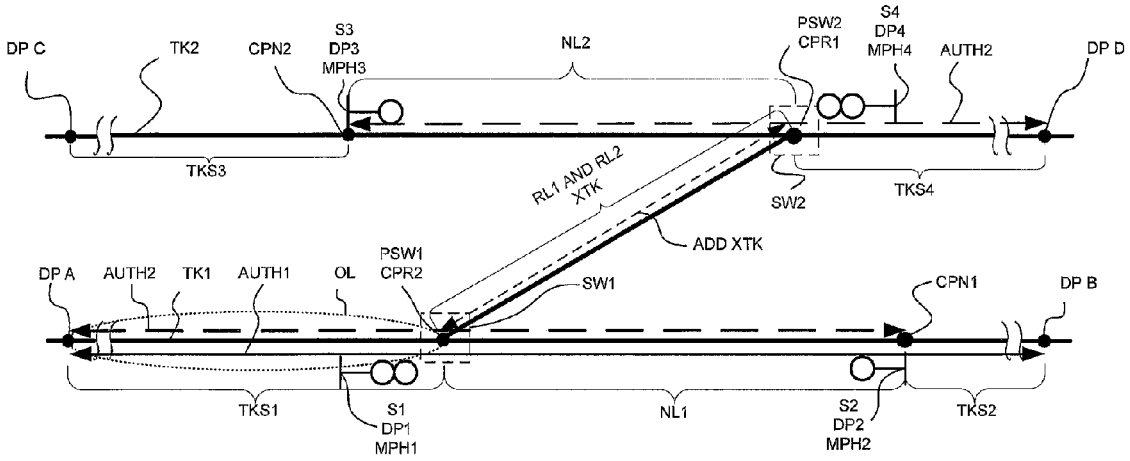

FIGS. 15(*a*)-(*b*) are schematic views of non-limiting exemplary embodiments of system and method for transforming movement authority limits and detecting conflicts or overlaps between two or more railway vehicles. In particular, FIG. 15(*a*) contains track and feature arrangements similar to those of non-limiting exemplary embodiments of FIGS. 8(*a*)-(*b*) and FIGS. 10(*a*)-(*b*). Additionally, FIG. 15(*b*) contains track and feature arrangements similar to those of non-limiting exemplary embodiments of FIGS. 9(*a*)-(*b*) and FIGS. 11(*a*)-(*b*). Moreover, the non-limiting exemplary embodiments of FIGS. 15(*a*)-(*b*) illustrate that despite some implementations of back office systems not requiring the addition of switch legs and/or crossover tracks, the non-limiting exemplary embodiments of FIGS. 9(*a*)-(*b*), FIGS. 10(*a*)-(*b*), and FIGS. 11(*a*)-(*b*) would continue to enable the back office systems to detect overlap or conflicts in authority between railway vehicles regardless of whether switch legs or crossover tracks are added by the back office systems. This is because conflicting authority limits would continue to be detected on at least one track segment associated with a switch or turnout.

In the non-limiting exemplary embodiment of FIG. 15(*a*), a first railway vehicle (not shown) may already hold Authority AUTH1 between Dispatchable Point DP A and Dispatchable Point DP B on Track TK. However, a second railway vehicle (not shown) may hold Authority AUTH2 between Dispatchable Point DP A and Dispatchable Point DP2 on Track TK; and between Dispatchable Point DP3 and Dispatchable Point DP C on Siding Track STK. As illustrated, Overlap OL between Authority AUTH1 for the first railway vehicle and Authority AUTH2 for the second railway vehicle will be detected even if the Reverse Leg RL is not added to the second railway vehicle's Authority Data and/or Train Authority Data because Authority AUTH1 and Authority AUTH2 both contain track on the facing side of the Switch SW or Track Segment TKS1. Moreover, the addition of Reverse Leg RL to second railway vehicle's Authority Data and/or Train Authority Data (i.e., ADD RL) has no effect on the detection of conflicts or overlaps on Track Segment TKS1.

In the non-limiting exemplary embodiment of FIG. 15(*b*), a first railway vehicle (not shown) may already hold Authority AUTH1 between Dispatchable Point DP A and Dispatchable Point DP B on Track TK1. However, a second railway vehicle (not shown) may hold Authority AUTH2 between Dispatchable Point DP A and Dispatchable Point DP2 on Track TK1; and between Dispatchable Point DP3 and Dispatchable Point DP D on Track TK2. As illustrated, Overlap OL between Authority AUTH1 for the first railway vehicle and Authority AUTH2 for the second railway vehicle will be detected even if the Crossover Track XTK is not added to second railway vehicle's Authority Data and/or Train Authority Data because Authority AUTH1 and Authority AUTH2 both contain track on the facing side of the Switch SW1 or Track Segment TKS1. Moreover, even if Crossover Track XTK is added to second railway vehicle's Authority Data and/or Train Authority Data (i.e., ADD XTK), no overlap or conflict would occur on Crossover Track XTK, because the Crossover Track XTK would not be added to the first railway vehicle's Authority Data and/or Train Authority Data. Accordingly, in some implementations, the Back Office System 108 and/or the On-Board Segment 110 may be programmed and/or configured to perform authority conflict checking on the facing side of a switch before or after the addition of switch legs and/or crossover tracks.

While the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

It is worthy to note that some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other. With respect to software elements, for example, the term "coupled" may refer to interfaces, message interfaces, API, exchanging messages, and so forth.

Further, unless specifically stated otherwise, it will be appreciated that terms such as, for example, "placing," "generating," "identifying," "comparing," "processing," "computing," "calculating," "determining," or the like, refer to the action and/or processes of a computer or computing system, or similar electronic computing device, that manipulates and/or transforms data represented as physical quantities (e.g., electronic) within registers and/or memories into other data similarly represented as physical quantities within the memories, registers or other such information storage, transmission or display devices.

While certain features of the embodiments have been illustrated as described above, many modifications, substitutions, changes and equivalents will now occur to those skilled in the art. It is therefore to be understood that the appended claims are intended to cover all such modifications and changes as fall within the true spirit of the embodiments.

The invention claimed is:

1. A computer-implemented method of transforming movement authority limits for a train traveling in a track network, comprising:

receiving, by at least one of a back office system, an on-board segment, and a wayside segment, authority data and/or train authority data provided by a dispatch system;

determining, by the at least one of the back office system, the on-board segment, and the wayside segment, authority associated with a switch leg, a first track segment including a point of switch, and a second track segment based at least partially on the authority data and/or train authority data provided by the dispatch system, wherein the authority data and/or train authority data provided by the dispatch system does not include authority associated with the switch leg, wherein the first track segment is adjacent to a switch and the second track segment is adjacent to the switch leg of the switch, such that the switch and the switch leg are located between the first track segment and the second track segment; and providing, by the at least one of the back office system, the on-board segment, and the wayside segment, authority on the switch leg based at least partially on the determined authority associated with the switch leg, the first track segment, and the second track segment.

2. The computer-implemented method of claim 1, further comprising:

receiving the authority data;

transforming the authority data into the train authority data; and verifying the train authority data, before providing authority on the switch leg.

3. The computer-implemented method of claim 2, wherein the step of verifying the train authority data further comprises:

calculating local hash data based at least partially on the train authority data in accordance with a hash function;

comparing the local hash data with remote hash data received from and calculated by the back office system; and executing at least one action, when the comparison of the remote hash data and local hash value data indicates a transformation error.

4. The computer-implemented method of claim 3, wherein the at least one action, comprises at least one of the following: displaying a visual warning, providing an audible warning, prompting for acknowledgement, notifying the dispatch system, or any combination thereof.

5. The computer-implemented method of claim 2, wherein the steps of receiving, transforming, verifying, determining, and providing are performed by a management system of the on-board segment on the train traveling in the track network.

6. The computer-implemented method of claim 1, wherein the authority on the switch leg is provided by adding the switch leg to the train authority data, when the train holds authority for the first track segment including the point of switch, the second track segment including the associated clearance point, and the train does not hold authority on the switch leg.

7. The computer-implemented method of claim 1, wherein the authority on the switch leg is provided by adding the switch leg to the train authority data, when the train holds authority for the first track segment including the point of switch, and the second track segment including the associated clearance point is uncontrolled, and the train does not hold authority on the switch leg.

8. The computer-implemented method of claim 1, wherein the authority on the switch leg is provided at least in part by adding the switch leg to the train authority data when the switch leg has an associated clearance point located between the second track segment and the switch leg, and the second track segment extends in advance of the clearance point.

9. The computer-implemented method of claim 1, wherein the authority data is provided in at least one authority dataset message and comprises at least one of the following: a track name, a mile post, a direction of travel, a minimum speed, a maximum speed, a time limit, or any combination thereof.

10. The computer-implemented method of claim 9, wherein the authority data is provided in a single authority dataset message.

11. A computer-implemented method of transforming movement authority limits for a train traveling in a track network, comprising:

receiving, by at least one of a back office system, an on-board segment, and a wayside segment, authority data and/or train authority data provided by a dispatch system;

determining, by the at least one of the back office system, the on-board segment, and the wayside segment, authority associated with a first track segment located on a first track, a second track segment located on a second track, and a switch leg of a switch located on the first track based at least partially on the authority data and/or train authority data provided by the dispatch system, wherein the first track segment and the second track segment are located at opposite ends of a crossover track between the first track and the second track, wherein the authority data and/or train authority provided by the dispatch system data does not include authority associated with the switch leg and the crossover track; and providing, by the at least one of the back office system, the on-board segment, and the wayside segment, authority on the crossover track based at least partially on the determined authority associated with the first track segment, the second track segment, and the switch leg.

12. The computer-implemented method of claim 11, further comprising:

receiving the authority data in a single authority dataset message; and transforming the authority data into the train authority data.

13. The computer-implemented method of claim 12, further comprising verifying the train authority data after providing authority on the crossover track and wherein the steps of receiving, transforming, determining, providing, and verifying are performed by a management system in the on-board segment on the train traveling in the track network.

14. The computer-implemented method of claim 13, wherein the step of verifying the train authority data further comprises:

calculating local hash data based at least partially on the train authority data in accordance with a hash function;

comparing the local hash data with remote hash data received from and calculated by the back office system; and executing at least one action, when the comparison of the remote hash data and local hash value data indicates a transformation error.

15. The computer-implemented method of claim 12, wherein the steps of receiving, transforming, determining, and providing are performed by the back office system.

16. The computer-implemented method of claim 12, wherein the step of providing authority on the crossover track further comprises providing authority on the crossover track, in response to receiving the single authority dataset message and wherein the step of transforming the authority data into train authority data further comprises transforming the authority limits data into the train authority data, in response to receiving the single authority dataset message.

17. The computer-implemented method of claim 11, wherein the authority on the crossover track is provided when the switch has an associated clearance point located between the second track segment and the crossover track, and the second track segment extends in advance of the clearance point.

18. The computer-implemented method of claim 11, wherein the authority on the switch leg is provided by adding the crossover track to the authority data and/or train authority data, when the train holds authority for the first track segment, the second track segment, and the switch leg.

19. The computer-implemented method of claim 11, wherein the steps of determining and providing are performed by a management system in the on-board segment on the train traveling in the track network.

20. A computer-implemented method of transforming movement authority limits for a train traveling in a track network, comprising:

receiving, by at least one of a back office system, an on-board segment, and a wayside segment, authority data and/or train authority data provided by a dispatch system;

determining, by the at least one of the back office system, the on-board segment, and the wayside segment, authority associated with a track segment, and a first switch leg of a switch based at least partially on the authority data and/or train authority data provided by the dispatch system, wherein the authority data and/or train authority data provided by the dispatch system does not include authority associated with the first switch leg of the switch and a second switch leg of the switch, wherein the track segment is adjacent to the switch, such that the switch is located between the track segment and the first switch leg; and providing, by the at least one of the back office system, the on-board segment, and the wayside segment, authority on the second switch leg based at least partially on the determined authority associated with the track segment and the first switch leg.

21. The computer-implemented method of claim 20, further comprising:

receiving authority data; and transforming the authority data into the train authority data.

22. The computer-implemented method of claim 20, further comprising verifying the train authority data after providing authority on the second switch leg and wherein the steps of receiving, transforming, determining, providing, and verifying are performed by a management system in the on-board segment on the train traveling in the track network.

23. A computer-implemented method of transforming movement authority limits for a train traveling in a track network, comprising:

receiving, by a management system on the train traveling in the network, authority data and/or train authority data provided by a dispatch system;

determining, by the management system on the train traveling in the network, authority associated with a switch leg, a first track segment including a point of switch, and a second track segment based at least partially on the authority data and/or train authority data provided by the dispatch system, wherein the authority data and/or train authority data provided by the dispatch system does not include authority associated with the switch leg, wherein the first track segment is adjacent to a switch and the second track segment is adjacent to the switch leg of the switch, such that the switch and the switch leg are located between the first track segment and the second track segment; and providing, by the management system on the train traveling in the network, authority on the switch leg based at least partially on the determined authority associated with the switch leg, the first track segment, and the second track segment.

24. A computer-implemented method of transforming movement authority limits for a train traveling in a track network, comprising:

receiving, by a back office system of a Positive Train Control (PTC) system including a plurality of different track networks including a plurality of different dispatch systems, authority data in a single authority dataset message provided by a dispatch office of the plurality of different dispatch systems;

determining, by the back office system of the PTC system, authority associated with a first track segment located on a first track, a second track segment located on a second track, and a switch leg of a switch located on the first track based at least partially on the authority data provided in the single authority dataset message by the dispatch office, wherein the first track segment and the second track segment are located at opposite ends of a crossover track between the first track and the second track, wherein the authority data provided in the single authority dataset message by the dispatch office does not include authority associated with the crossover track; and providing, by the back office system of the PTC system, authority on the crossover track based at least partially on the determined authority associated with the first track segment, the second track segment, and the switch leg, in response to receiving the single authority dataset message that contains authority for at least a portion of the first track segment, at least a portion of the second track segment, and at least a portion of the switch leg.

25. A computer-implemented method of transforming movement authority limits for a train traveling in a track network, comprising:

receiving, at an on-board management system on a train traveling in a track network and communicating in Positive Train Control (PTC) system including a plurality of different track networks including a plurality of different dispatch systems, authority data and/or train authority data from a dispatch system of the plurality of different dispatch systems, the authority data and/or train authority data providing authority on a first track segment including a switch and a second track segment, wherein the first track segment is adjacent to the switch and the second track segment is adjacent to a switch leg of the switch, such that the switch and the switch leg are located between the first track segment and the second track segment, wherein the authority data from the dispatch system does not include authority associated with the switch leg; and providing, at the on-board management system on the train traveling in the track network, authority on the switch leg based on the authority associated with the first track segment and the second track segment.

26. The computer-implemented method of claim 25, further comprising:

determining, at the on-board management system on the train traveling in the track network, a number of authority segments in the authority data and/or train authority data;

identifying, at the on-board management system on the train traveling in the track network, a sequence or list of blocks within each authority segment; and providing, at the on-board management system on the train traveling in the track network, authority for each block within each authority segment.

* * * * *